US009207557B2

(12) United States Patent
Fukuda et al.

(10) Patent No.: US 9,207,557 B2
(45) Date of Patent: Dec. 8, 2015

(54) IMAGE FORMING APPARATUS

(71) Applicant: CANON KABUSHIKI KAISHA, Tokyo (JP)

(72) Inventors: Tadashi Fukuda, Matsudo (JP); Norihiko Kubo, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 13/728,103

(22) Filed: Dec. 27, 2012

(65) Prior Publication Data

US 2013/0177328 A1 Jul. 11, 2013

(30) Foreign Application Priority Data

Jan. 10, 2012 (JP) ..... 2012-002190

(51) Int. Cl.
*G03G 15/02* (2006.01)

(52) U.S. Cl.
CPC ..... *G03G 15/0266* (2013.01)

(58) Field of Classification Search
CPC ..... G03G 15/0266; G03G 15/0216; G03G 2215/021
USPC ..... 399/50
See application file for complete search history.

(56) References Cited

U.S. PATENT DOCUMENTS

| | | | | |
|---|---|---|---|---|
| 8,005,380 | B2 | 8/2011 | Kubo | |
| 2003/0111218 | A1 * | 6/2003 | Iguchi et al. | 165/200 |
| 2009/0304404 | A1 * | 12/2009 | Okuno et al. | 399/44 |
| 2010/0111550 | A1 | 5/2010 | Kubo | |

FOREIGN PATENT DOCUMENTS

| | | | | |
|---|---|---|---|---|
| CN | 101354556 | A | | 1/2009 |
| JP | 54-143645 | A | | 11/1979 |
| JP | 2001-201920 | A | | 7/2001 |
| JP | 2008107605 | A | * | 5/2008 |
| JP | 2011-154262 | A | | 8/2011 |

OTHER PUBLICATIONS

Machine translation of JP 2008107605 A.*

Office Action issued in Chinese Patent Application No. 201310008708.7, dated Jan. 28, 2015.

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image forming apparatus includes a photosensitive member (drum); a rotatable charging member for electrically charging the drum; a bias applying device for applying a charging bias to the charging member in the form of a DC voltage biased with an AC voltage; a current detector for detecting an AC current passing between the charging member and the drum; a temperature and humidity detector; a setting device for setting a condition of the charging bias on the basis of a plurality of detected AC currents passing between the charging member and the drum when a plurality of AC voltages depending on an output of the temperature and humidity detector are applied to the charging member; and a corrector for correcting the set condition of the charging bias on the basis of an output of the current detector when a predetermined AC voltage is applied to the charging member.

6 Claims, 15 Drawing Sheets

(a)

(b)

(a)

(b)

(a)

(b)

(a)

(b)

IMAGE FORMING APPARATUS

FIELD OF THE INVENTION AND RELATED ART

The present invention relates to an image forming apparatus such as a copying machine, a printer, a facsimile machine or a multi-function machine having a plurality of functions of these machines.

In the image forming apparatus of an electrophotographic type, a surface of a photosensitive drum as a photosensitive member is electrically charged and exposed to light, so that an electrostatic latent image is formed and then is developed with a developer to form a developer image, and thereafter the developer image is transferred onto another photosensitive member such as a recording material. The recording material on which the developer image is transferred is pressed and heated by a fixing device, so that the developer image is fixed on the recording material. The developer remaining on the photosensitive drum after the transfer is removed by a cleaning device.

In such an image forming step, as a charging member for effecting the charging, a roller-type charging member is used, and a charging type in which the roller-type charging member is opposed to the photosensitive drum surface and the photosensitive drum surface is charged by applying a voltage to the charging member has been widely employed. In the charging type using the roller-type charging member (charging roller), stable charging can be effected for a long term.

As a type of charge control, as disclosed in Japanese Laid-Open Patent Application (JP-A) 2001-201920, a type in which an AC voltage is switched to a plurality of sampling values and corresponding values of currents passing through the photosensitive drum are detected to calculate a relationship between the AC voltage and the current and on the basis of a calculation result, a proper AC voltage is determined has been known.

In recent years, as the roller-type charging member, in many cases, a charging member using a high electric charge-responsive substance such as an ion-conductive agent is used since life extension is intended to be realized. In the case of such a structure, the structure strongly resists a fluctuation by continuous use but on the other hand, compared with the roller-type charging member using an electron-conductive agent, a change in charging characteristic by an environment fluctuation, i.e., a fluctuation in relationship between an AC peak-to-peak voltage and a discharge amount is conspicuous. For this reason, only by effecting control simply so that an AC current Iac passing through the photosensitive drum is detected and is kept constant, the charging member cannot follow the change in charging characteristic in some cases. In these cases, a phenomenon such as drum abrasion or image blur due to excessive discharge is caused or an improper charge image due to insufficient electric charge is generated.

Further, the charging member using the ion-conductive agent involves a problem such that a resistance is remarkably increased in a low humidity environment and thus the electric discharge is not started until a considerably high peak AC voltage is applied to the photosensitive drum (hereinafter the peak AC voltage at which the electric discharge is started is referred to as a discharge start voltage).

Here, in FIGS. 13 and 14, the charging characteristic of the charging roller using the ion-conductive agent is shown. Part (*a*) of FIG. 13 is a graph showing a relationship between an absolute water content in a surrounding environment and a discharge start voltage of the charging roller, and (*b*) of FIG. 13 is a graph showing a relationship between the absolute water content and a necessary discharge amount. Part (*a*) of FIG. 14 is a graph showing a relationship between an ambient temperature and the charging roller discharge start voltage, and (*b*) of FIG. 14 is a graph showing a relationship between the ambient temperature and the necessary discharge amount.

As is apparent from FIGS. 13 and 14, with respect to the charging roller using the ion-conductive agent, when the ambient temperature is a room temperature (25° C.±5° C.) in an ordinary office, the discharge start voltage and the necessary discharge amount predominant depend on the water content. On the other hand, in a low-temperature environment (15° C. or less), dependency on the temperature becomes predominant. From the characteristic of the ion-conductive agent, transfer of the electric charge at normal temperature is active but an electric charge transferability is remarkably lowered, so that an energized state of the charging roller is lowered. That is, the resistance is extremely increased and largely affects the discharge start voltage and the necessary discharge amount.

Therefore, when the charging roller is used, a method in which an environment in which an (image forming) apparatus us currently placed is detected by a temperature and humidity sensor of the apparatus and then a high-voltage applying condition is changed thereby to suppress generation of the improper charge image would be considered. For example, JP-A 2011-154262 discloses that a fluctuation in charge position due to a change in temperature of the charging roller is suppressed by controlling a voltage applied to the charging roller depending on a temperature obtained by a temperature measuring portion provided in the apparatus when the charging roller is used. However, such control is based on the premise that the temperature recognized by the temperature and humidity sensor of a main assembly and a temperature of the charging roller accommodated in the apparatus coincide with each other, i.e., that an ambient temperature of the charging roller conforms to an ambient temperature of the temperature and humidity sensor of the main assembly.

However, an actual environment sensor of the image forming apparatus is an external sensor in general in many cases, and is provided at a place when the sensor is kept out of sight of a user. Further, in the case where temperature and humidity in the apparatus are intended to be accurately discriminated, as described in JP-A 2011-154262, there is also a product in which an internal sensor is provided. However, also this sensor is provided at a target place where consumable parts are less taken out and in since disposition of the sensor at a periphery of the consumable parts, such as a drum cartridge (CRG), which are frequently replaced leads to a high possibility of contamination or break and thus increases a risk of breakage or erroneous detection. That is, it is difficult to dispose the sensor in the neighborhood of the charging roller, and in general, the sensor is provided at a place considerably remote from the charging roller and therefore in many cases, the actual temperature of the charging roller is materially different from a detection result of the temperature and humidity sensor.

Further, the charging roller is lowered in electric charge transferability in the low-temperature environment. For this reason, even when the temperature is instantaneously increased, the electric charge transferability is not instantaneously restored, but electric charge responsiveness is gradually improved with an ambient temperature charge, thus restoring the charge transferability.

FIG. 15 shows a relationship between an AC voltage (Vpp) of the charging roller and an AC current (μA) passing through the photosensitive drum at that time in the case where the actual charging roller temperature corresponds to the detection temperature of the main assembly temperature and humidity sensor and in the case where the actual charging roller temperature is lower than the detection temperature of the main assembly temperature and humidity sensor. Incidentally, the case where the actual charging roller temperature corresponds to the detection temperature of the main assembly temperature and humidity sensor (broken line in FIG. 15) is based on assumption of the case where the actual charging roller temperature conforms to the detection temperature of the main assembly temperature and humidity sensor. Further, the case where the actual charging roller temperature is lower than the detection temperature of the main assembly temperature and humidity sensor (solid line in FIG. 15) is based on assumption of the case where the actual charging roller temperature does not conform to the detection temperature of the main assembly temperature and humidity sensor but the charging roller is in a lower temperature environment than the detection temperature.

As is apparent from FIG. 15, in the case where the actual charging roller temperature does not conform to the detection temperature of the main assembly temperature and humidity sensor, impedance becomes high, so that even when the same AC voltage as that in the case of conformity with the detection temperature is applied, a proper AC current does not flow. For this reason, the photosensitive drum cannot be electrically charged sufficiently.

Therefore, when high-voltage control in which a high voltage is applied to the charging roller while relying on the temperature and humidity sensor provided in the main assembly, in the case where the charging roller is not sufficiently accustomed to the ambient temperature, there is a possibility that the above-described improper charge image is generated. As the case where the roller is not accustomed as described above, e.g., the following case would be considered. The case where the main assembly has already been mounted in an operation environment of the user during the winter, and a service person carries the drum ORG (cartridge), left standing in an outside environment, into the user's operation environment in order to replace the drum CRG as the consumable part and then instantaneously replaces and mounts the drum CRG in the main assembly. In this case, the main assembly temperature and humidity sensor detects the user's operation environment in which the main assembly is placed and will set a condition of the high voltage to be applied to the charging roller, but the actual charging roller temperature is still kept at the temperature in the outside environment. For this reason, the improper charge image as described above is generated. Further, the charging roller left standing for a long time in the low toner environment is not restored from the resistance rise state until the charging roller is sufficiently accustomed to the surrounding environment, and therefore the charging roller cannot be early restored from a situation in which the improper charge image is generated.

Further, in addition to during the mounting, a similar phenomenon is observed also in the case where an air conditioner in the user's operation environment in which the main assembly is placed is turned off during the night in the winter season and the main assembly is placed in the low temperature environment. Even if on the following day, the ambient environment is restored from the low temperature environment, a situation in which only a peripheral portion of the main assembly temperature and humidity sensor is warmed but the ambient temperature of the charging roller is not increased is present. For this reason, similarly as described above, the improper charge image is generated. Further, the charging roller left standing for a long term in the low-toner environment cannot be early restored from the status in which the improper charge image is generated. Also this is similarly generated.

These problems are conspicuous with respect to the charging roller using the ion-conductive agent but are also generated with respect to other charging rollers.

SUMMARY OF THE INVENTION

The present invention is accomplished in view of the above-described circumstances. A principal object of the predetermined present invention is to provide an image forming apparatus capable of properly setting a condition of a charging bias to be applied to a rotatable charging member even when a detection result of a temperature and humidity detector of a main assembly and an actual temperature of a rotatable charging member are different from each other.

These and other objects, features and advantages of the present invention will become more apparent upon a consideration of the following description of the preferred embodiments of the present invention taken in conjunction with the accompanying drawings.

Figure 10:
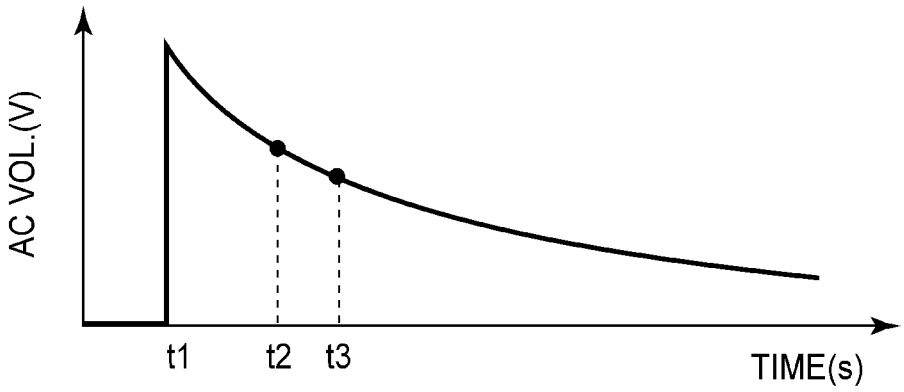
Figure 10:
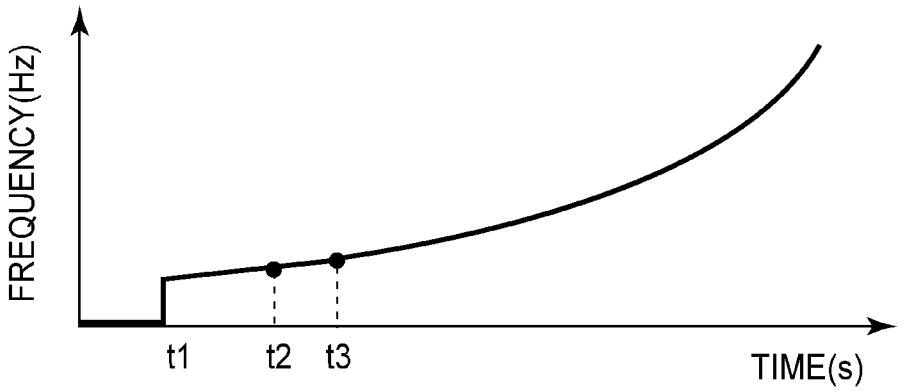

Parts (*a*) and (*b*) of FIG. 10 are graphs showing a relationship between an elapsed time and an AC voltage ((a)) and a relationship between the elapsed time and a frequency ((b)) in the case where an actual charging roller temperature is lower than a detection result of a main assembly temperature and humidity detector.

Figure 11:
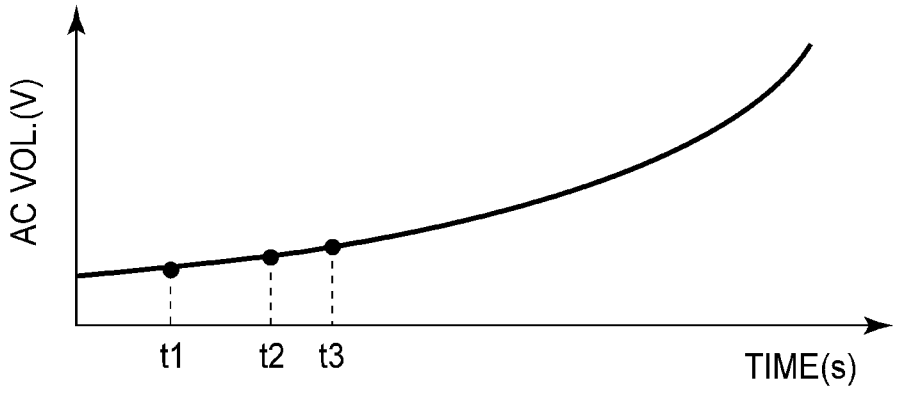
Figure 11:
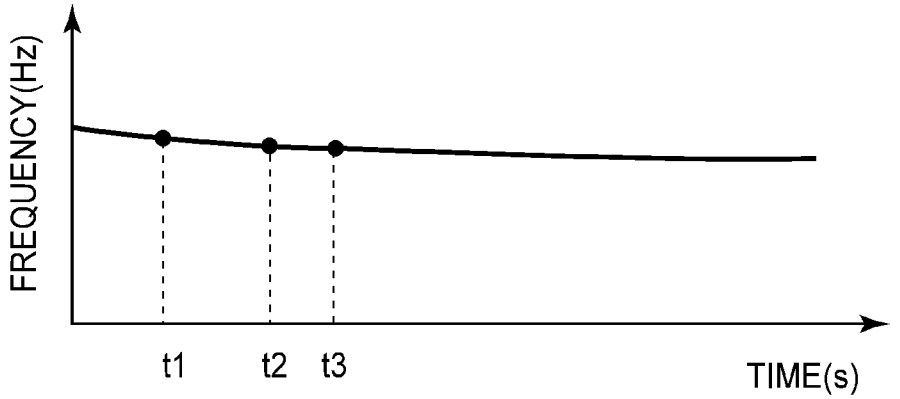

Parts (*a*) and (*b*) of FIG. 11 are graphs showing a relationship between the elapsed time and an AC voltage ((a)) and a relationship between the elapsed time and a frequency ((b)) in the case where an actual charging roller temperature is higher than a detection result of a main assembly temperature and humidity detector.

Figure 12:
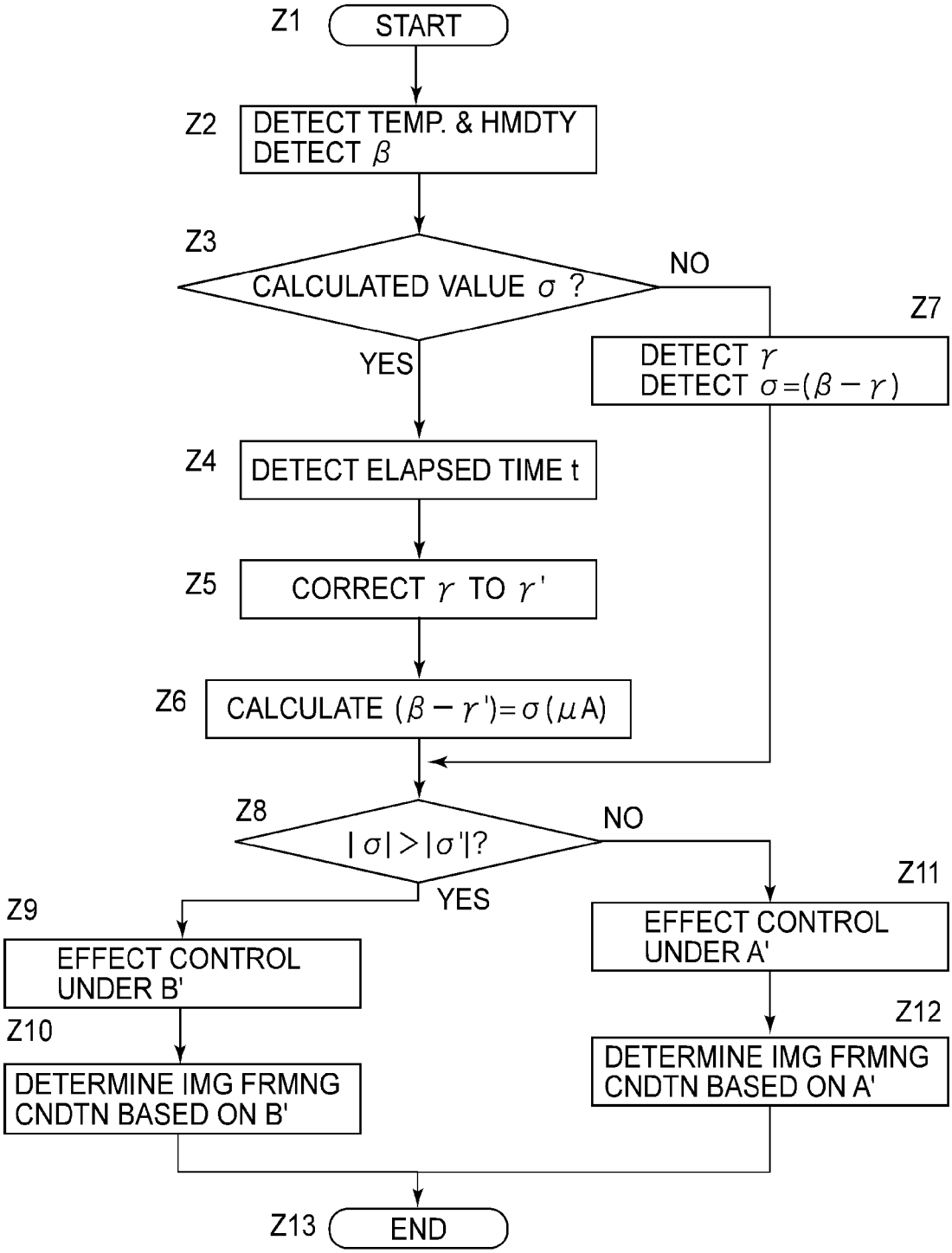

FIG. 12 is a flow chart of control of setting of a charging condition in Third Embodiment.

Figure 13:
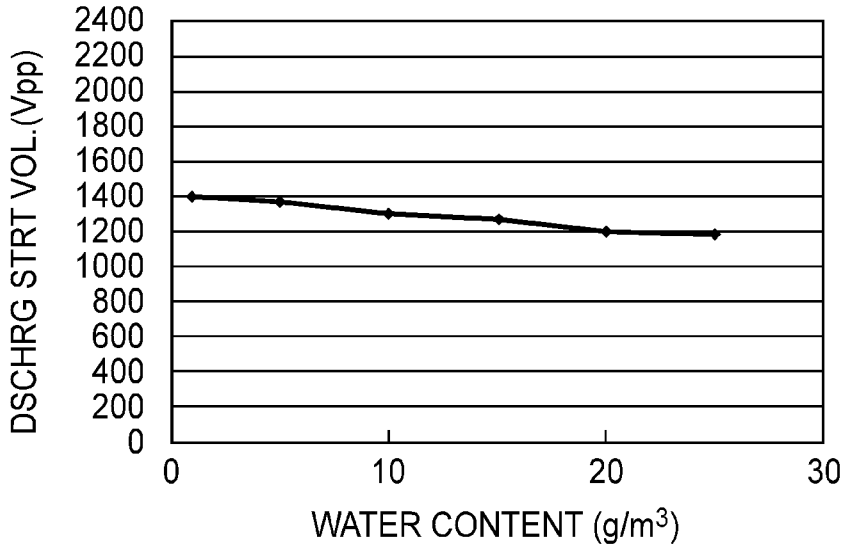
Figure 13:
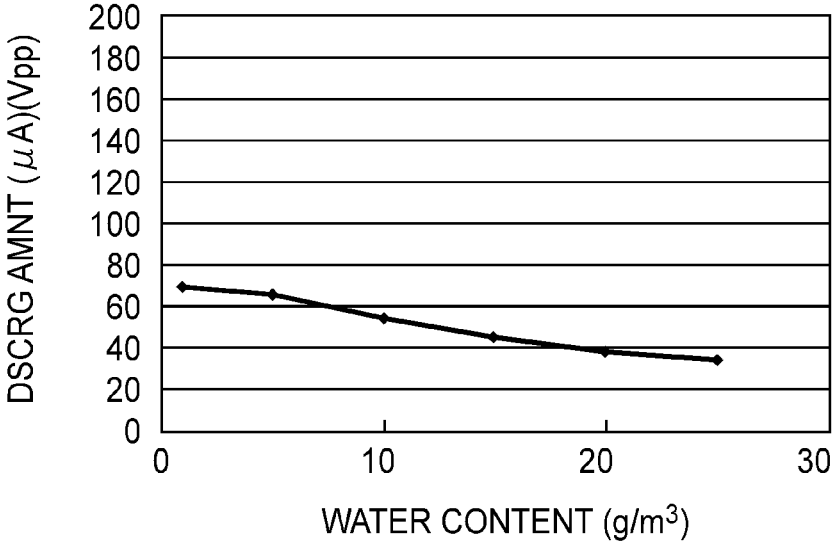

Parts (*a*) and (*b*) of FIG. 13 are graphs showing a relationship between an ambient absolute water content of a charging roller using an ion-conductive agent and a discharge start voltage ((a) and a relationship between the ambient absolute water content and a necessary discharge amount.

Figure 14:
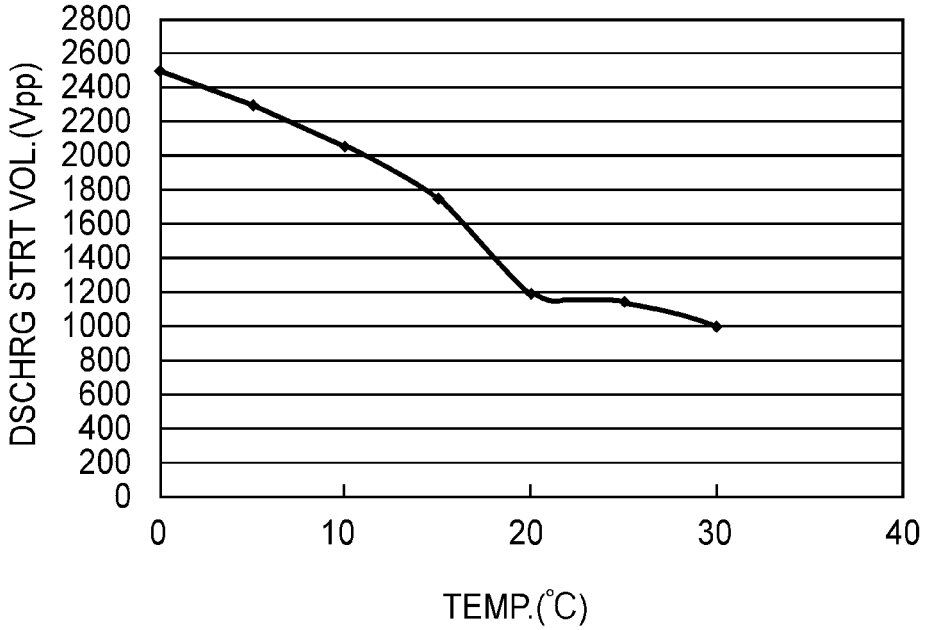
Figure 14:
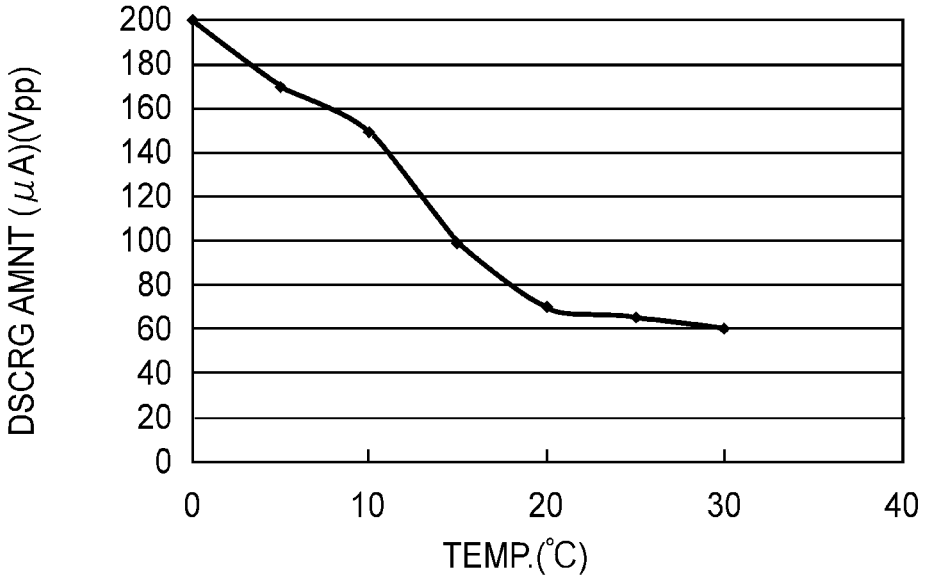

Parts (*a*) and (*b*) of FIG. 14 are graphs showing a relationship between an ambient temperature of a charging roller using an ion-conductive agent and a discharge start voltage ((a) and a relationship between the ambient temperature and a necessary discharge amount.

Figure 15:
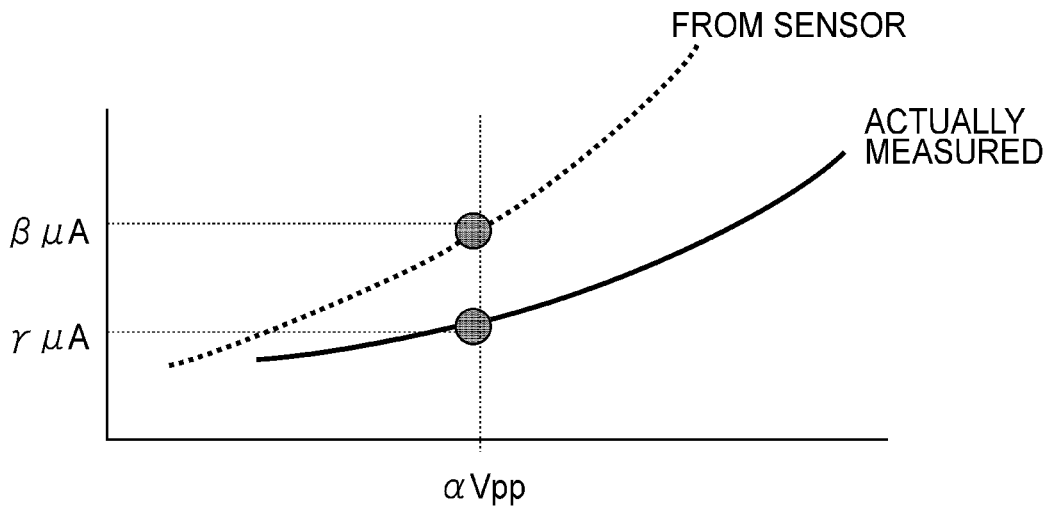

FIG. 15 is a graph showing a proper relationship between an AC voltage and an AC current (V-I characteristic) of a charging member with respect to a detection result of a temperature and humidity sensor and a relationship between the AC voltage and the AC current (V-I characteristic) of the charging member with respect to an actual temperature, in a state in which the actual temperature of the charging member is still a low temperature.

DESCRIPTION OF THE PREFERRED EMBODIMENTS

<First Embodiment>

First Embodiment of the present invention will be described with reference to FIGS. 1 to 4. First, with reference to FIG. 1, a general structure of an image forming apparatus in this embodiment will be described.

[Image Forming Apparatus]

The image forming apparatus in this embodiment is a tandem-type four-color-based full-color image forming apparatus in which four image forming units (stations) are disposed side by side along a movement direction of an endless belt-type intermediary transfer member.

An image output portion 1P roughly includes an image forming unit 10 (including for stations Pa, Pb, Pc and Pd which are disposed side by side and have the same constitutions) a sheet feeding unit 20, an intermediary transfer unit 30, a fixing unit 40, and a control unit (not shown).

Each of the units of the image forming apparatus will be described more specifically. Each of photosensitive drums 11 (11*a*, 11*b*, 11*c*, 11*d*) as a photosensitive drum is shaft-supported at its center and is rotationally driven in a direction indicated by an arrow. Oppositely to an outer peripheral surface of the photosensitive drum 11 (11*a*, 11*b*, 11*c*, 11*d*), along the rotational direction of the photosensitive drum, a charging roller 12 (12*a*, 12*b*, 12*c*, 12*d*) as a charging member (rotatable charging member), a laser scanner unit 13 (13*a*, 13*b*, 13*c*, 13*d*) as an exposure unit and a developing device 14 (14*a*, 14*b*, 14*c*, 14*d*) are disposed.

The charging rollers 12*a*-12*d* provide a uniform charge amount to the surfaces of the photosensitive drums 11*a*-11*d* to electrically charge the drum surfaces. Then, the photosensitive drums 11*a*-11*d* are exposed, by the laser scanner units 13*a*-13*d*, to light beams such as laser beams modulated depending on recording image signals, so that electrostatic latent images are formed on the photosensitive drums 11*a*-11*d*. Then, the electrostatic latent images are developed by the developing devices 14*a*-14*d* in which developers (toners) of colors of yellow, cyan, magenta and black, respectively, are accommodated, so that toner images are formed. Further, as a characteristic of the color toners, it is preferable that a weight-average particle size is 5-8 μm for forming a good image.

The toner images formed on the respective photosensitive drums 11*a*-11*d* are transferred superposedly onto an intermediary transfer belt 31 by applying transfer biases to primary transfer rollers 35*a*, 35*b*, 35*c* and 35*d* as the transfer unit at primary transfer portions Ta, Tb, Tc and Td. Downstream of the primary transfer portions Ta, Tb, Tc and Td of the respective photosensitive drums 11*a*-11*d*, toners remaining on the photosensitive drums 11*a*-11*d* without being transferred onto the intermediary transfer belt 31 are scraped off by cleaning devices 15*a*, 15*b*, 15*c* and 15*d*, so that the respective drum surfaces are cleaned. By the above-described process, image forming operations with the respective toners are successively performed.

As each of the photosensitive drums 11*a*-11*d*, a negatively chargeable OPC photosensitive drum was used. Specifically, as a photosensitive member layer, a negatively chargeable organic semiconductor layer (OPC layer) obtained by laminating a 29 μm-thick CTL layer (carrier transporting layer), in which hydrazone and a resin material are mixed, on a CGL layer (carrier generating layer) of an azo pigment was used. Detail will be described later.

The cleaning device 15 (15*a*, 15*b*, 15*c*, 15*d*) will be described. As the cleaning devices, a counter blade type cleaning device is used and a free length of a cleaning blade is 8 mm. The cleaning blade 16 is an elastic blade principally comprising urethane resin and is contacted to the photosensitive drum with a linear pressure of about 35 g/cm.

The sheet-feeding unit 20 includes cassettes 21*a* and 21*b* for accommodating the recording material P, and a manual feeding tray 27. Further, the unit 20 includes pick-up rollers 22*a*, 22*b* and 26 for feeding the recording material S one by one from the cassettes 21*a* and 21*b* or the manual feeding tray 27, and sheet-feeding roller pairs 23 which are used for conveying the recording material P, fed from each of the pick-up rollers, to registration rollers. The unit 20 further includes a sheet-feeding guide 24 and the registration rollers 25*a* and 25*b* for sensing the recording material S to a secondary transfer portion Te as a transfer unit in synchronism with image formation timing of the image forming unit 10.

The intermediary transfer unit 30 constituting the transfer unit will be described in detail. As a material for the intermediary transfer belt 31, it is possible to use, e.g., PET (polyethylene terephthalate) and PVdF (polyvinylidene fluoride). Such an intermediary transfer belt 31 is wound around a driving roller 32 for transmitting a driving force to the belt, a tension roller 33 for applying proper tension to the intermediary transfer belt 31 by urging of springs (not shown), and a follower roller 34 which opposes the secondary transfer portion Te via the belt. Of these rollers, between the driving roller 32 and the tension roller 33, a primary transfer flat surface A is created. The driving roller 32 is constituted by coating the surface of a metal roller with a several mm-thick layer of a rubber (urethane rubber or chloroprene rubber), thus being prevented from slipping on the belt. The driving roller 32 is rotationally driven by a pulse motor (not shown).

In the primary transfer portions Ta-Td in which the photosensitive drums 11*a*-11*d* and the intermediary transfer belt 31 oppose each other, primary transfer rollers 35 (35*a*, 35*b*, 35*c*, 35*d*) are disposed on the back surface of the intermediary transfer belt 31. The secondary transfer roller 36 is disposed oppositely to the follower roller 34 to form the secondary transfer portion Te in a nip belt itself and the intermediary transfer belt 31. A secondary transfer roller 36 is urged against the intermediary transfer belt (member) 31 under a proper pressure.

Further, in the rotational direction of the intermediary transfer belt 31, downstream of the secondary transfer portion Te, a brush roller (not shown) for cleaning an image forming surface of the intermediary transfer belt 31 and a residual toner box (not shown) for containing residual toner are provided. Further, on the intermediary transfer belt 31, a cleaning device 100 for removing secondary transfer residual toner is provided.

The fixing unit 40 includes a fixing roller 41*a* provided with a heat source such as a halogen heater inside the fixing roller 41*a* and includes a pressing roller 41*b* to be pressed by the fixing roller 41*a*. The pressuring roller 41*b* may also contain the heat source. The fixing unit 40 further includes a guide 43 for guiding the recording material P into a nip between the fixing roller 41*a* and the pressing roller 41*b*, and inner sheet discharging rollers 44 and outer sheet discharging rollers 45 for guiding the recording material P, discharged from the nip, to the outside of the image forming apparatus. Such a fixing unit 40 fixes the toner images on the recording material by pressing and heating the recording material on which the toner images are transferred.

The control unit is constituted by a control board for controlling operations of mechanisms in the above-described respective units and by a motor drive board (not shown) and the like. Further, an environment sensor 50 as a temperature and humidity detector detects a temperature and a humidity inside or outside the image forming apparatus. In this embodiment, the environment sensor 50 is disposed at a position, indicated in FIG. 1, remote from the fixing unit 40 in the apparatus main assembly so that an ambient temperature/humidity of the image forming apparatus can be accurately measured without being influenced by the fixing unit 40 which is a heat source in the image forming apparatus.

As an example of such an environment sensor 50, a temperature and humidity sensor ("SHT1X series", mfd. by Sensirion Co., Ltd.) may be used. The environment sensor 50 is a CMOS device in which outputs of a sensing element and a band gap temperature sensor are coupled by an A/D converter and then serial output is performed through a digital interface. The sensing element is a humidity detecting device and is an electrostatic capacity polymer as a capacitor in which a polymer is inserted as a dielectric member. This sensing device has a humidity detecting function of converting the electrostatic capacity into the humidity by using a characteristic such that a content of water absorbed by the polymer is linearly changed depending on the humidity. Further, the band gap temperature sensor is a temperature detecting device and is constituted by a thermistor linearly changed in resistance value with respect to the temperature, and the temperature is calculated from the resistance value.

Further, in the neighborhood of the fixing unit 40, an exhaust fan 37 as an exhaust device for exhausting air inside the image forming apparatus is provided. This exhaust fan 37 is actuated in interrelation with an unshown air supplying fan and exhausts the air in the image forming apparatus. Such an exhausts fan 37 is capable of controlling a volume of the air.

Next, the charging rollers 12*a*, 12*b*, 12*c* and 12*d* (hereinafter, collectively referred to as the charging roller 12 in some cases) which are the charging member will be described. A roller surface layer of the charging roller 12 was formed of 1-2 mm thick electroconductive rubber in which an electroconductive material such as carbon black was dispersed and mixed, and was controlled so that a resistance value thereof was $10^5$ to $10^7$ ohm·cm in order to prevent charging non-uniformity during the image formation. Further, as the charging roller 12, the charging roller of a contact type in which it is contactable to the photosensitive drum without creating a gap by utilizing its elasticity is used, and the photosensitive drum is charged at a low voltage.

Incidentally, as the charging roller 12, the charging roller in which an ion-conductive polymer compound such as polyether ether amide is contained may also be used. In this constitution, on a surface of an electroconductive support, ABS resin which contains the ion conductive polymer compound and is controlled so as to have a resistance value of $10^5$ to $10^7$ ohm·cm is coated in a thickness of 0.5 to 1 mm by injection molding to form a resistance adjustment layer. On the surface of the resistance adjustment layer, a protective layer of a thermoplastic resin composition containing electroconductive fine particles of tin oxide or the like dispersed therein is formed. As the electroconductive support to which a charging voltage is to be applied, a metal shaft member is used. The metal shaft member is constituted integrally by a shaft-supporting (bearing) portion, a voltage-applying shaft-supporting portion, and a coating portion providing an outer diameter of 14 mm. On the peripheral surface of the coating layer, the resistance adjustment layer, of the ABS resin (thermoplastic resin) containing the ion-conductive polymeric compound such as polyetherester amide, adjusted to have a volume resistivity of $10^5$ to $10^7$ ohm·cm is coated in the thickness of 0.5 to 1 mm by the injection molding.

Further, in this embodiment, each of the charging rollers 12*a*, 12*b*, 12*c* and 12*d*, each of the photosensitive drums 11*a*, 11*b*, 11*c* and 11*d*, and each of the cleaning devices 15*a*, 15*b*, 15*c* and 15*d* are integrally assembled into a drum cartridge. Further, by replacing the drum cartridge, the charging roller, the photosensitive drum and the cleaning device can be collectively replaced as consumables. Types of such a drum cartridge may vary from a type in which the service person replaces the drum cartridge to a type in which the user himself (herself) can replace the drum cartridge, but the cartridge used in this embodiment can be replaced by the user himself (herself). Procedures or the like for the replacement (exchanging) are displayed on a display portion provided on the main assembly.

Each of photosensitive drums 11*a*, 11*b*, 11*c* and 11*d* (hereinafter collectively referred to as the photosensitive drum 11 in some cases) is an organic photosensitive member constituted by laminating on a support A an undercoat layer B, a charge generating layer C, and a charge transporting layer D. The support A is not particularly limited so long as it exhibits electroconductivity and does not adversely affect measurement of hardness. For example, as the support A, it is possible to use a drum-like molded product of metal or alloy such as aluminum, copper, chromium, nickel, zinc, or stainless steel.

The undercoating layer B is formed for improving an adhesive property of the photosensitive layer, improving a coating property of the photosensitive layer, protecting the support, coating a defect on the support, improving a charge injection property from the support, or protecting the photosensitive layer from electrical breakdown.

As a material for the undercoat layer B, it is possible to use polyvinyl alcohol, poly-N-vinylimidazole, polyethylene oxide, ethyl cellulose, ethylene-acrylic acid copolymer, casein, polyamide, N-methoxymethyl 6-nylon, copolymer nylon, glue, and gelatine. These materials are dissolved in an appropriate solvent and then are applied onto the surface of the support. A thickness of the undercoat layer B may suitably be 0.1-2 μm.

In the case where the photosensitive layer of a functionally-separated type, in which the charge generation layer C and the charge transport layer D are function-separated and laminated, is formed, the charge generation layer C and the charge transfer layer D are laminated on the undercoat layer B in this order. As the charge generating substance used for the charge generating layer C, it is possible to use selenium- tellurium (Se—Te) alloy, pyrilium dyes, thiapyrylium dyes, and compounds having various center metal elements and crystal systems. Specifically, it is possible to use phthalocyanine compounds having crystal systems such as α type, β type, γ type, ϵ type, and X type; anthoanthorone pigments; dibenzpyrenequinone pigments; pyranthorone pigments; and trisazo pigments. It is also possible to use disazo pigments, monoazo pigments, indigo pigments, quinacridone pigments, asymmetrical quinocyanine pigments, quinocyanine, and amorphous silicon as described in JP-A Sho 54-143645. In this embodiment, the charge generation layer using the phthalocyanine compound capable of enhancing sensitivity in order to realize high image quality was used.

[Charging bias control]

Figure 2:
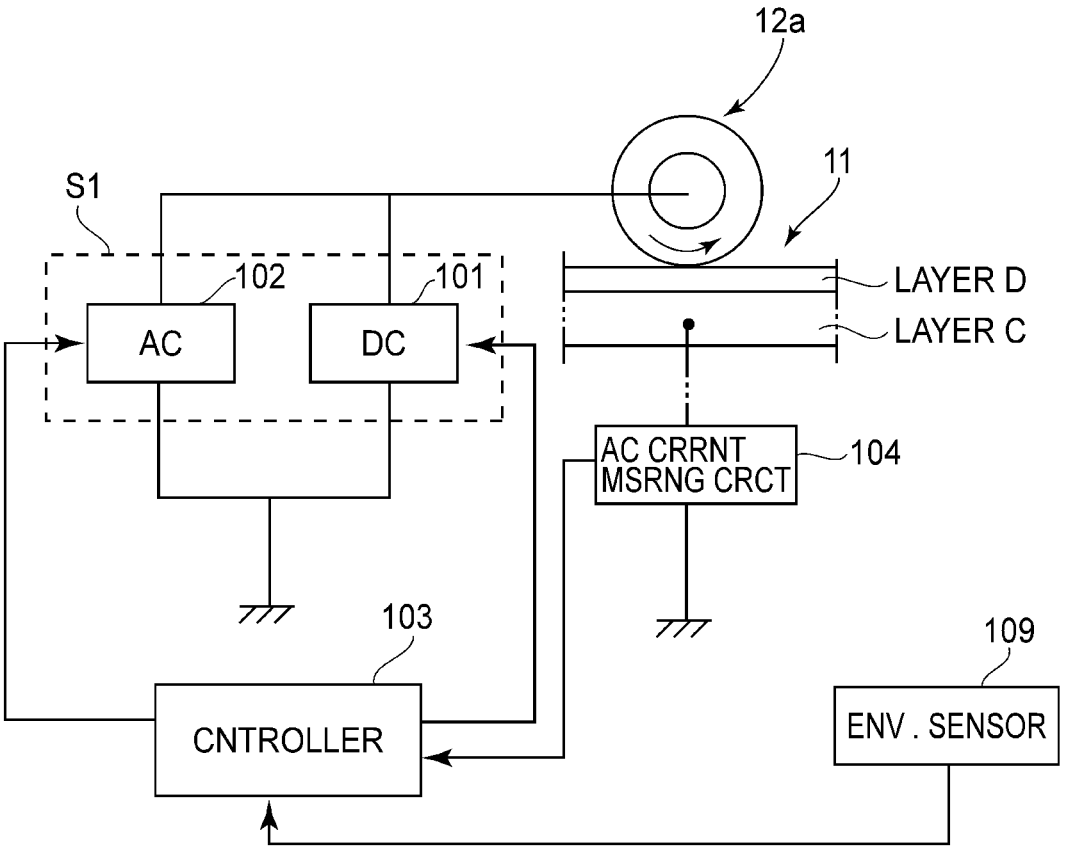
FIG. 2 is a block diagram of charging bias control.

FIG. 2 is a block circuit diagram of a charging bias application system to the charging roller 12.

A predetermined oscillating voltage in the form of a DC voltage biased (superposed) with an AC voltage having a frequency f (bias voltage: Vdc+Vac) is applied from a power source S1 to the charging roller 12 via the core metal, so that the peripheral surface of the rotating photosensitive drum 1 is charge-processed to a predetermined potential. The power source S1 as a charging bias applying device to the charging roller 12 includes a DC power source 101 and an AC power source 102.

A control circuit 103 as a setting device controls the power source S1 so that either one or both of the DC voltage and the AC voltage of the superposed voltage are applied to the charging roller 2 by turning the DC power source 101 or/and the AC power source 102 of the power source S1 on or off. The control circuit 103 also controls the DC voltage value applied from the DC power source 101 to the charging roller 12 and the peak-to-peak voltage value of the AC voltage applied from the AC power source 102 to the charging roller 12.

Measured AC current value information is inputted, into the above-control circuit 103, from an AC current value measuring circuit 104 as a current detector for measuring a value of AC current passing through the charging roller 12 via the photosensitive drum 11, i.e., for obtaining a value of current flowing between the charging member and the photosensitive member.

From an environment sensor 50 for detecting the environment in which the image forming apparatus is mounted, detected environment information is inputted into the above control circuit 103. The environment information inputted into the control circuit 103 is temperature information and relative humidity information. The control circuit 103 calculates absolute water content from the information temperature and humidity information, and on the basis of the calculated absolute water content, effects settings of a high charging voltage condition (charging condition), a high developing voltage condition, a high transfer voltage condition and the like. That is, the control circuit 103 effects the detecting of each of the conditions correspondingly to the temperature and the humidity which are detected by the environment sensor 50.

Further, the charging condition corresponding to the temperature and the humidity which are detected by the environment sensor 50 is changed depending on a predetermined condition described later. This change is made in both of the case where a high charging voltage condition during image formation is changed directly as in this embodiment and the case where a control condition used in control for determining a charging AC peak voltage to be applied during image formation as in Second Embodiment described later.

The control circuit executes a computing and determining program of a proper peak-to-peak voltage of the AC voltage applied to the charging roller in a charging step of printing step on the basis of the AC current value information inputted from the AC current value measuring circuit 104 and the environment information inputted from the environment sensor 50.

That is, also as described above, the impedance of the charging roller 12 is largely changed depending on the operation environment of the image forming apparatus. For this reason, when an amount of the discharge current passing from the charging roller 12 to the photosensitive drum 11 is controlled, there is a need to consider the operation environment of the image forming apparatus, particularly the absolute water content in the operation environment. For that reason, in this embodiment, as shown in FIG. 2, the environment sensor 50 for detecting the temperature and the humidity in the image forming apparatus is provided in the image forming apparatus, and information on the temperature and the relative humidity in the image forming apparatus is inputted into the control circuit 103. The control circuit 105 calculates the absolute water content in the operation environment from the temperature and the relative humidity which are inputted from the environment sensor 50. Then, at least one of the AC voltage and a AC voltage frequency which are the charging condition of the charging voltage applied to the charging roller 12 during the image formation is variably controlled depending on the operation environment (absolute water content).

Here, when a relative humidity is Ψ (%), a dry temperature is t (° C.), a partial water vapor pressure in humid (moist) air is P (mmHg), a partial water vapor pressure in saturated humid air is ps (mmHg), and a total (full) pressure in humid air is p (mmHg), from the following equation, an absolute water content X is calculated. Incidentally, a standard atmospheric pressure is constant at 760 mmHg.

$$X=0.622\times\Psi\times ps/(P-\Psi\times ps)\ (\text{kg/kg}') \quad (1)$$

Further, the relative humidity Ψ is obtained from the following equation.

$$\Psi=p/ps\ (\%) \quad (2)$$

[Setting of Charging Condition]

Next, setting of the charging condition in this embodiment will be described. First, when a predetermined voltage α is applied to the charging roller 12, a current value detected by the AC current value measuring circuit 1094 is γ. Further, in the case where the predetermined voltage α is applied to the charging roller 12 at the temperature and the humidity which are detected by the environment sensor 50, a proper value of current passing between the charging roller 12 and the photosensitive drum 11 is β. In this case, a difference between the proper current value β and the detected current value γ is σ. That is, σ=(proper current value β)−(detected current value γ).

Next, a limit value of an absolute value |α| of the difference σ corresponding to the temperature and the humidity which are detected by the environment sensor 50 is |σ'|. In the case where |σ| is larger than |σ'|, on the basis of positive (+) and negative (−) is σ, the charging condition corresponding to the temperature and the humidity which are detected by the environment sensor 50 is changed. In other words, the charging condition is differentiated between the case where |γ| exceeds |σ'| and the case where |σ| is not more than |σ'|. Further, also between the case where σ is positive, i.e., the case where the detected current value γ is smaller than the proper current value β and the case where σ is negative, i.e., the case where the detected current value γ is larger than the proper current value β, the charging condition is differentiated.

More specifically, first, in the case where |σ| exceeds |σ'|, i.e., in the case where the difference between the proper current value β and the detected current value γ is large, an AC temperature of the charging roller 12 can be discriminated that it is largely deviated from a detection result of the environment sensor 50. Therefore, in this case, the charging condition set depending on the detection result of the environment sensor 50 is corrected depending on the positive and negative of σ.

That is, in the case where σ is positive (the case where the detected current value γ is smaller than the proper current value β), it would be considered that the impedance of the charging roller 12 is high and therefore the actual temperature of the charging roller 12 can be discriminated that it is lower than the detection result of the environment sensor 50. On the other hand, in the case where σ is negative (the case where the detected current value is larger than the proper current value β), it would be considered that the impedance of the charging roller 12 is low and therefore the actual temperature of the charging roller 12 can be discriminated that it is higher than the detection result of the environment sensor 50.

For this reason, in the case where σ is positive, compared with the charging condition set depending on the detection result of the environment sensor 50, the charging condition is changed so that the AC voltage is high and the frequency is small. On the other hand, in the case where σ is negative, compared with the charging condition set depending on the detection result of the environment sensor 50, the charging condition is changed so that the AC voltage is low and the frequency is high. Incidentally, in this case, the frequency may also be not changed.

On the other hand, in the case where |σ| is not more than |σ'|, i.e., in the case where the difference between the proper current value β and the detected current value γ is 0 or small, the deviation between the actual temperature of the charging roller 12 and the detection result of the environment sensor 50 can be discriminated as being small or absent. Therefore, in this case, the charging condition set depending on the detection result of the environment sensor 50 is not changed but is used as it is. The above-described respective charging conditions with respect to the environment and σ, and the limit value σ' are obtained in advance by an experiment or the like, and are stored in a memory.

Figure 3:
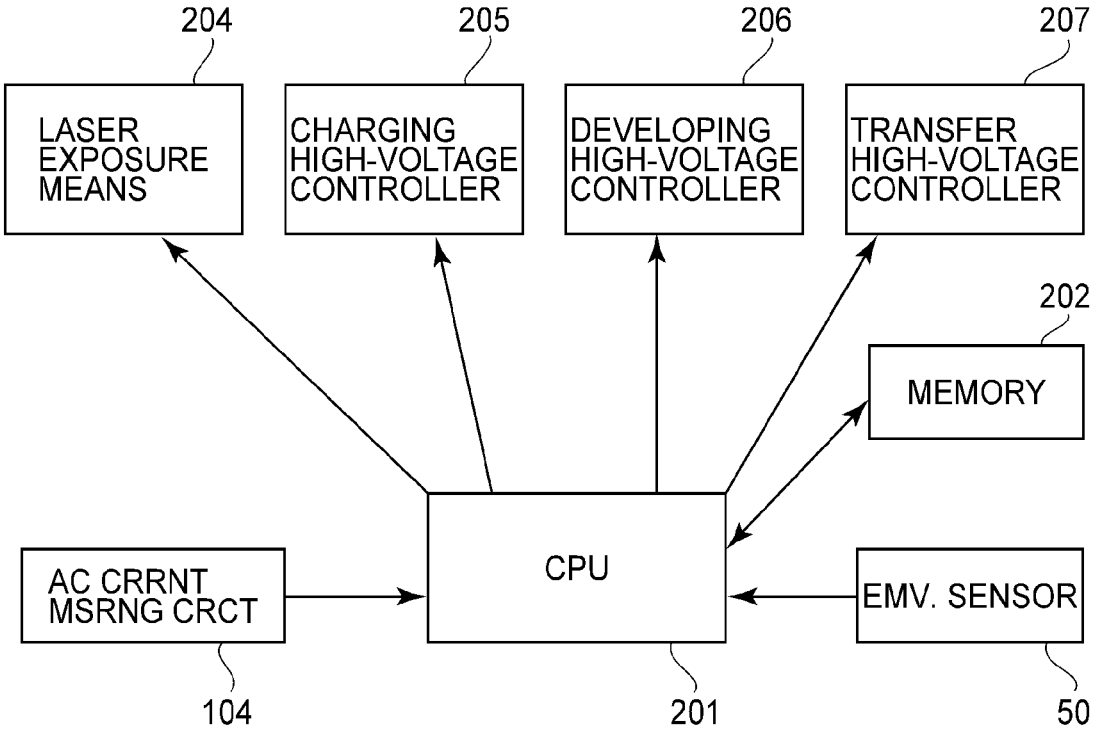
FIG. 3 is a control block diagram of the image forming apparatus.
Figure 4:
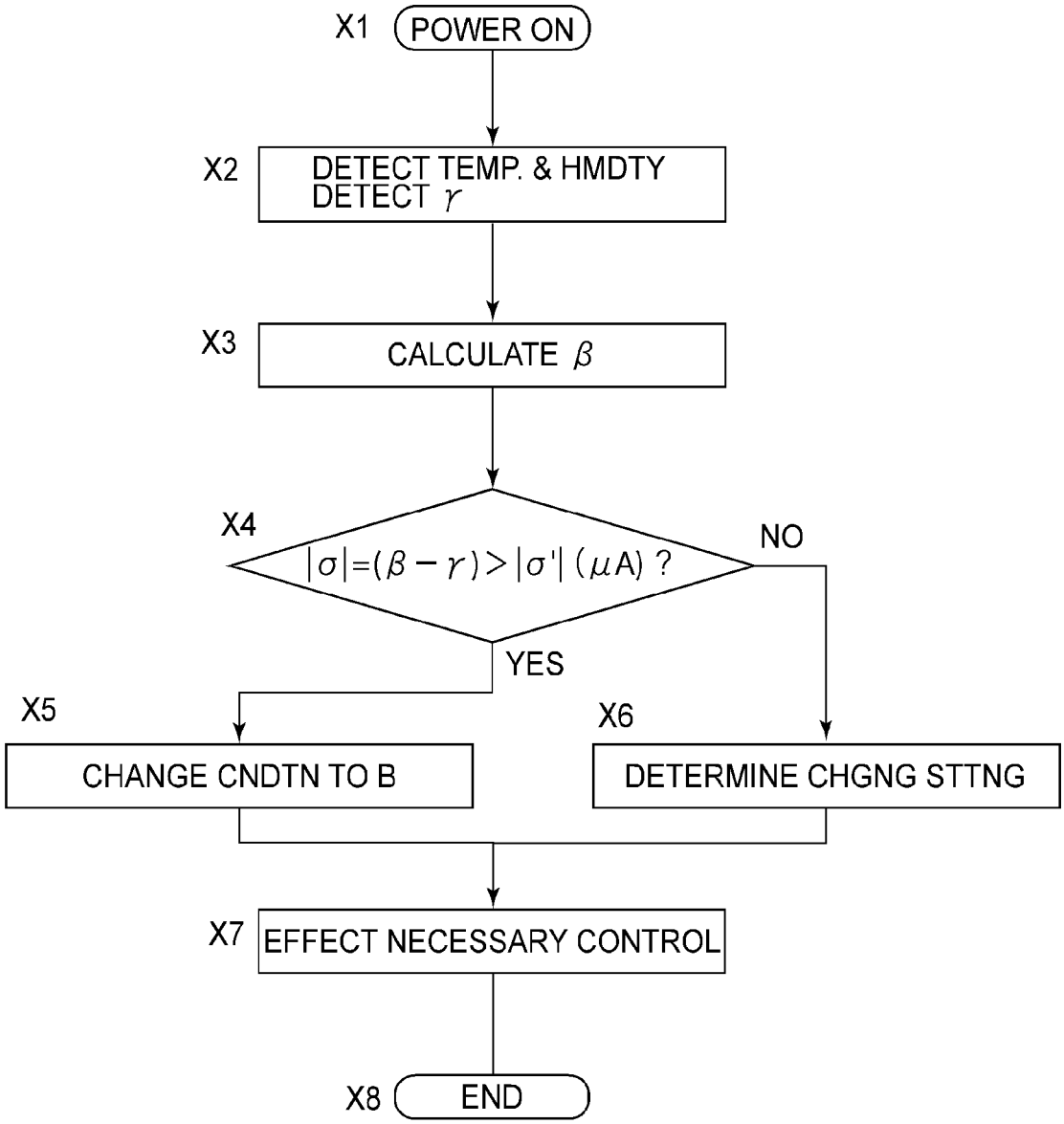
FIG. 4 is a flow chart of control of setting of a charging condition in First Embodiment.

With reference to FIGS. 3 and 4, an example of a flow of control of setting of the above-described charging condition will be described. Incidentally, the charging condition set correspondingly to the detection result of the environment sensor 50 is referred to as condition A, and a charging condition changed from the condition A based on the above-described σ is referred to as condition B. That is, a difference of the impedance of the charging roller from the impedance corresponding to the detection result of the environment sensor 50 is recognized by CPU 201, which is a control means of the apparatus main assembly, as a setting device and a corrector which are incorporated in the control circuit 103. Then, the charging condition is changed from the condition A set correspondingly to the detection result of the environment sensor 50, and is used as the condition B.

When a main power source of the main assembly is turned on (X1), the main assembly CPU 201 obtains information on the temperature and the humidity inside the apparatus main assembly from the environment sensor 50 in order to know the environment in which the main assembly is placed, and stores the information in a memory 202 in the main assembly. Then, the CPU 201 provides instructions, to a charging high-voltage control means 205, that a constant voltage αVpp is applied as a charging AC voltage to the charging roller 12. In FIG. 2, the CPU 201 and the charging high-voltage control means 205 constitute the control circuit 102 in combination.

The main assembly CPU 201 detects, from the AC current value measuring circuit 104, information on the charging AC current γ (μA) passing through the photosensitive drum 1 when the charging AC voltage αVpp is applied (X2), and stores the information in the main assembly memory 202. Then, the main assembly CPU 201 derives the proper current value β, under application of the constant AC voltage αVpp, stored as the information in the memory 202 in advance, as information, depending on present setting of the temperature and the humidity in the image forming apparatus obtained from the environment sensor 50 (X3). Then, a differential current σ (μA) is calculated on the basis of formula X' from the proper AC current value β stored in advance and an actually obtained value γ (μA) of the charging AC current passing through the photosensitive drum 11 when the charging AC voltage αVpp is applied.

$$\sigma = (\text{proper AC current value } \beta) - (\text{actually measured AC current value } \gamma) \quad \text{(formula X')}$$

The CPU 201 discriminates whether or not the absolute value |σ| of the calculated differential current value is larger than an environment limit value |σ'| stored as information in the memory 202 in advance depending on the present temperature and humidity setting in the image forming apparatus (X4). Then, the CPU 201 changes, in the case where |σ| is larger than the environment limit value |σ'|, the charging condition to the charging setting condition B different from the charging setting condition A set in advance depending on the present temperature and humidity setting in the image forming apparatus. This condition B is determined in a consideration of the positive and negative of σ. The charging condition to be changed is at least one of the AC voltage frequency and the AC voltage value (X5).

The setting of the frequency is not frequently changed but is changed in general correspondingly to a peripheral speed of the photosensitive drum 11 so as not to exert influence on generation of moire. However, it has been known that by lowering the frequency, it is possible to achieve an effect of alleviating abnormal electric discharge on the photosensitive drum 11 and possible to increase a charging ability with respect to the photosensitive drum 11. Therefore, with respect to a phenomenon such that fog, sandy place and the like are generated with respect to the charging roller abruptly increased in impedance in the low-toner environment or the like, an important effect is achieved by lowering the charging frequency. That is, by lowering the charging frequency, the impedance is lowered and thus it is possible to reduce a degree of the occurrence of the phenomenon of generation of the fog, the sandy place, and the like.

In this embodiment, the charging control is effected by constant voltage control and thus the applied voltage for the charging setting is determined as the AC voltage. Therefore, the charging setting changed under the condition B is the charging AC voltage. However, in the case where the main assembly effects the charging control by constant current control, the AC current value may preferably be changed.

Here, the reason why the absolute values such as |σ| and |σ'| are used as the differential current value and the environment limit value is as follows. In a state in which the charging roller is lower in temperature than the ambient temperature and humidity and thus the impedance becomes high, the proper current β becomes larger than the actual current γ, so that the differential current α becomes large in the positive (+) side. On the other hand, in a state in which the charging roller is higher in temperature than the ambient temperature and humidity and thus the impedance becomes low, the proper current β becomes smaller than the actual AC current γ, so that the differential current α becomes large in the negative (−) side. Therefore, in order to discriminate as to how large the difference σ is, there is a need to use the absolute value.

As the case where the charging roller temperature is higher than the ambient temperature, the case where in a state the apparatus main assembly is mounted in a cooling environment in an office in the summer season, a drum cartridge, in which the charging roller is mounted, which is left standing in the outside and thus becomes hot is mounted into the apparatus main assembly would be considered. In this case, there is a possibility of generation of image flow and turning-up of the blade of the cleaning device by excessive current from the charging roller. Therefore, in this embodiment, for the purpose of preventing the generation of the image flow and the blade turning-up, also in the case where the proper current β becomes larger than the actual current γ, the charging condition is changed.

On the other hand, in the case where the above-described differential current value |σ| is not more than the environment limit value |σ'|, the CPU 201 determines the charging setting on the basis of the ordinary charging setting condition A set in advance depending on the present temperature and humidity setting. As the charging condition, similarly as described above, the charging frequency, the charging AC voltage value or the like is set in general (X6).

Thus, the CPU 201 discriminates whether or not the above-described differential current value |σ| is larger than the environment limit value |σ'|. Then, the CPU 201 changes the charging setting correspondingly to each of the charging conditions A and B, and then depending on the determined charging setting, executes the image formation, an initial disposing operation, or necessary control for determining another image forming condition (X7).

The initial disposing operation refers to an initializing operation of the developer when the developing device is mounted, an initializing operation of the drum cartridge when the drum cartridge is mounted, or the like operation. The necessary control for determining another image forming condition refers to toner content control, control for determining primary transfer setting or the like, or the like control.

Specifically, correspondingly to the temperature and humidity detected by the environment sensor 50 and the charging condition set by the CPU 201, settings of a laser exposure means 204 as an exposure device, a developing high-voltage control means 206 and a transfer high-voltage control means 207 are made. The laser exposure means 204 effects, e.g., PWM (pulse width modulation) control of the laser scanner units 13*a*, 13*b*, 13*c* and 13*d*. The developing high-voltage control means 206 controls voltages (charging bias) applied to the developing devices 14*a*, 14*b*, 14*c* and 14*d*. The transfer high-voltage control means 207 controls voltages (transfer bias) applied to the primary transfer rollers 35*a*, 35*b*, 35*c* and 35*d* and the secondary transfer portion Te. That is, correspondingly to the change in charging condition, also control conditions of the various devices are changed.

Further, in order to know an environment in which the main assembly is placed, information obtaining timing of the temperature and the humidity in the image forming apparatus from the environment sensor 50 by the CPU 201 is not limited to only timing when the main power source is turned on but the information may also be always obtained. Further, the information may also be obtained at the time of start of a copy job. Therefore, the above-described contact flow is always performed every copy job, so that the charging setting condition may be determined. By always obtaining the information on the temperature and the humidity, even during a continuous copying operation, it is also possible to change the setting in a sheet interval or the like.

A specific example of a normal charging condition A, a magnitude correlation between |σ| and |σ'| and a particular charging condition B changed depending on the positive and negative of σ, at each of combinations of the temperatures and the humidities is shown in Table 1.

TABLE 1

| DETECTED | | AWC | | | | | | CONDITION A | | CONDITION B | |
|---|---|---|---|---|---|---|---|---|---|---|---|
| T (° C.) | H (%) | (g/kgDryAir) | α (Vpp) | β (μA) | γ (μA) | σ (μA) | \|σ'\| (μA) | V (Vpp) | F (Hz) | V (Vpp) | F (kHz) |
| 15 | 50 | 5.28 | 1000 | 750 | 700 | 50 | 200 | 1500 | 2000 | — | — |
| 15 | 50 | 5.28 | 1000 | 750 | 500 | 250 | 200 | — | — | 2000 | 1750 |
| 20 | 35 | 5.07 | 1000 | 800 | 500 | 300 | 280 | 1550 | 2000 | 2000 | 1750 |
| 25 | 50 | 9.88 | 1000 | 1000 | 650 | 350 | 300 | 1350 | 2000 | 1900 | 1750 |
| 30 | 80 | 21.58 | 1000 | 1400 | 900 | 500 | 450 | 1250 | 2000 | 1800 | 1750 |
| 30 | 80 | 21.58 | 1000 | 1400 | 1800 | −400 | 300 | 1250 | 2000 | 1100 | 2000 |
| 20 | 35 | 5.07 | 1000 | 800 | 1100 | −300 | 200 | 1550 | 2000 | 1400 | 2000 |

According to this embodiment, by calculating σ, the difference between the detection result by the main assembly environment sensor 50 and the actual temperature of the charging roller 12 can be grasped. Further, the charging condition is changed on the basis of this difference and therefore even when the detection result by the environment sensor 50 and the actual temperature of the charging roller 12 are different from each other, the charging condition of the charging roller 12 can be set properly. As a result, it is possible to suppress the generation of the phenomenon such as low-temperature fog and the sandy place.

<Second Embodiment>

Figure 1:
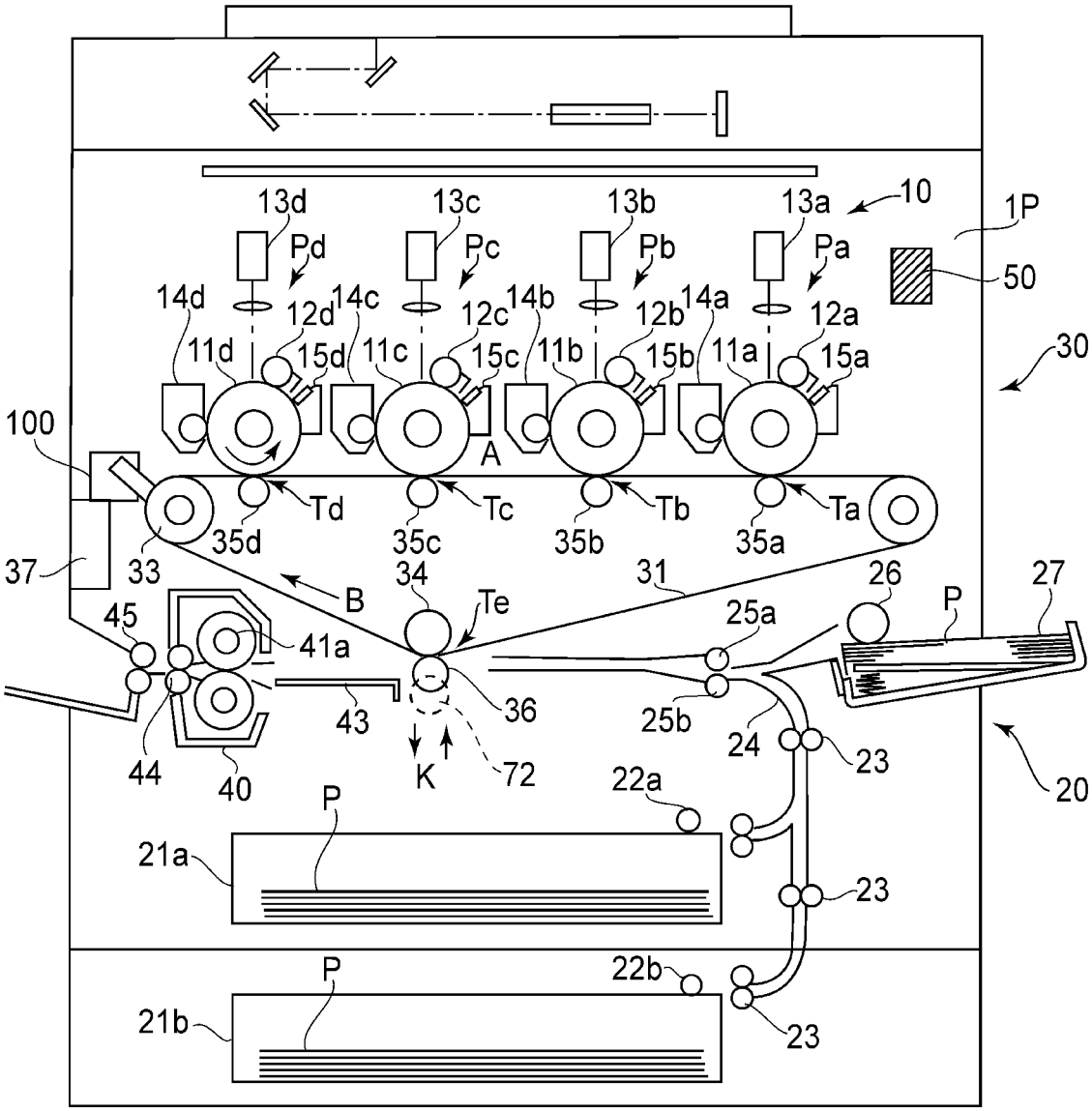
FIG. 1 is a schematic illustration of an image forming apparatus according to First Embodiment of the present invention.

Second Embodiment of the present invention will be described with reference to FIGS. 5 to 8 while making reference to FIGS. 1 to 3. In First Embodiment described above, the charging condition is changed by directly changing the charging high-voltage condition during the image formation but in this embodiment, a control condition used in control for determining a charging AC peak voltage to be applied during the image formation is changed.

That is, in this embodiment, the CPU 201 switches the AC voltage to be applied to the charging roller 12 to a plurality of sampling values corresponding to the temperatures and the humidities detected by the environment sensor 50 and then each of corresponding current values is detected by the AC current value measuring circuit 104. As a result, a relationship between the AC voltage and the AC current is calculated and on the basis of its calculation result, an AC voltage with respect to a target current value corresponding to the detected temperature and humidity is determined to set the charging condition. Also in this embodiment, similarly as in the above-described First Embodiment, the differential current value σ is obtained and then the charging condition is changed along a flow shown in FIG. 5. That is, in the case where |σ| is larger than |σ'|, on the basis of the positive and negative of σ, the charging condition is set by changing at least one of the plurality of sampling values corresponding to the temperatures and humidities detected by the environment sensor 50, the target current, and the AC voltage frequency.

Figure 5:
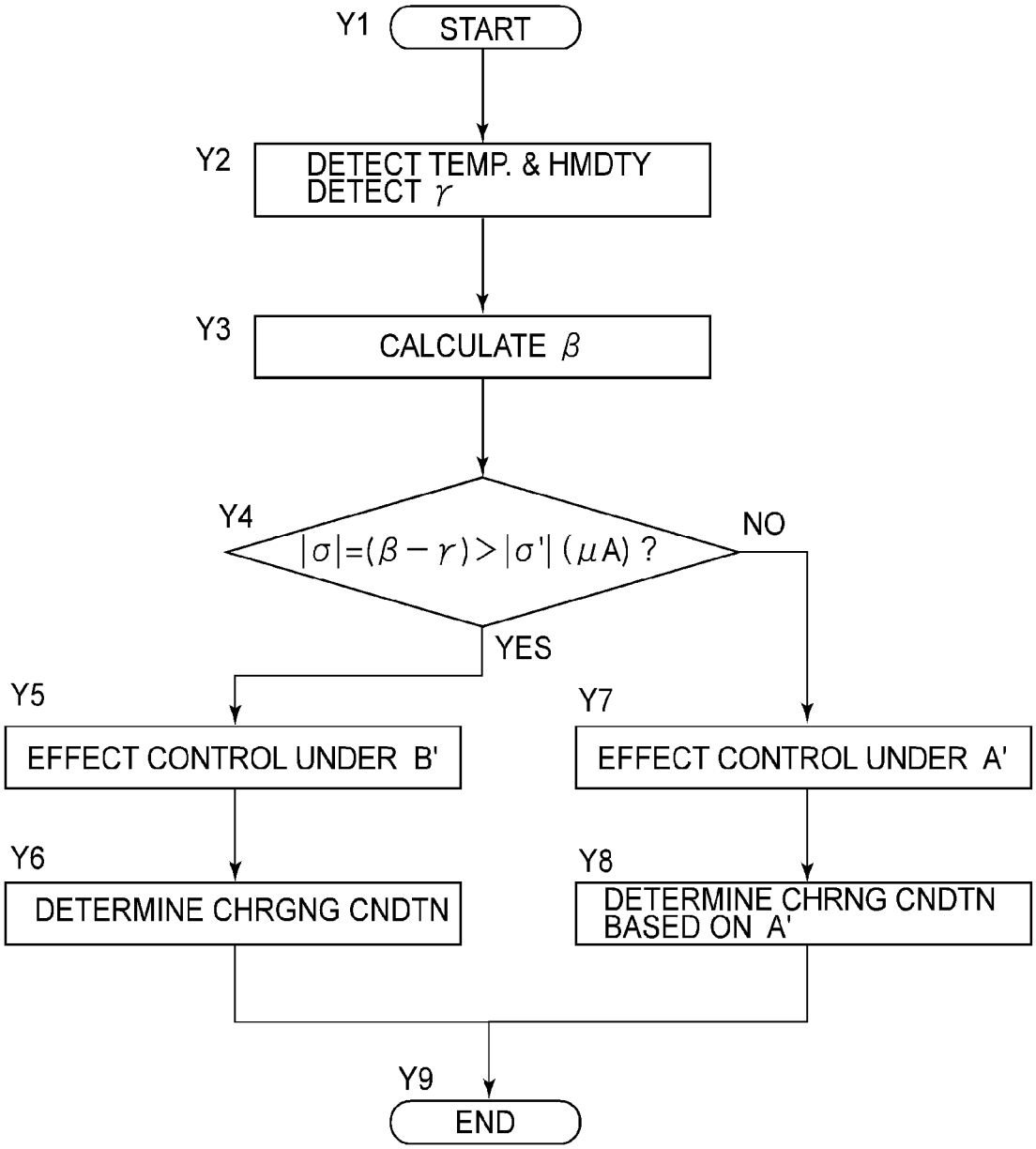
FIG. 5 is a flow chart of control of setting of a charging condition in Second Embodiment of the present invention.
Figure 6:
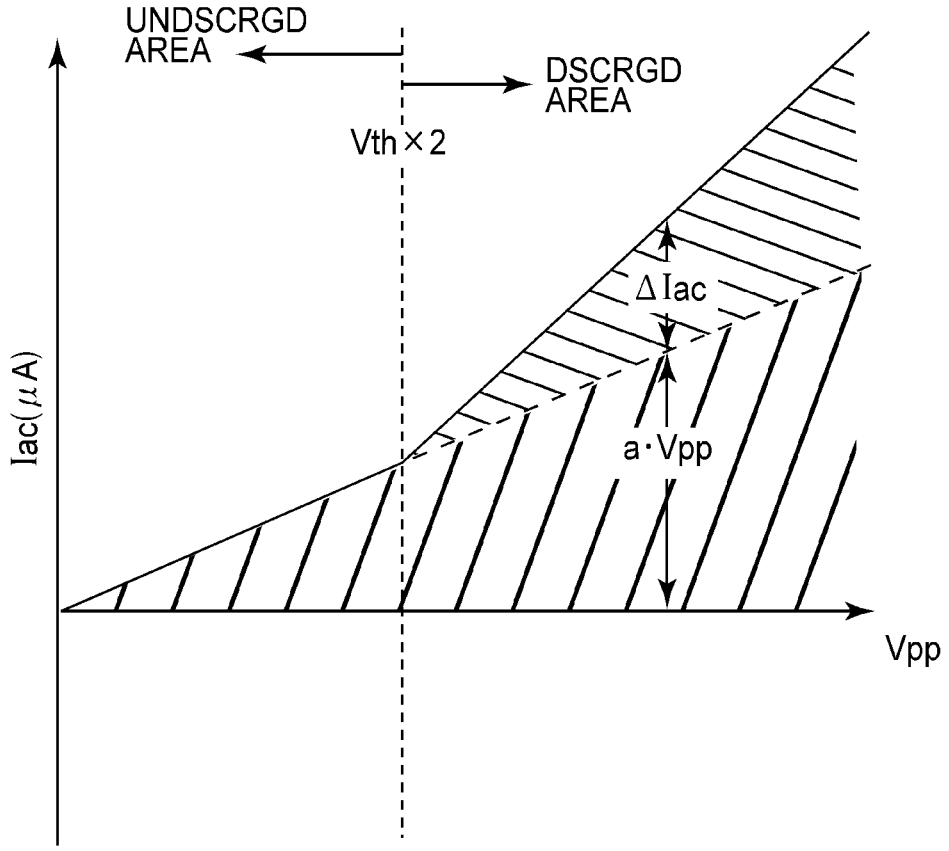
FIG. 6 is a graph showing a relationship between a peak-to-peak voltage and an AC current.

This will be specifically described below. It has been found by various studies that a discharge current amount converted into numerical value according to a definition described below is used as a substitution for an actual amount of AC discharge and strongly correlated with abrasion of the photosensitive drum, image deletion, and charging uniformity. As shown in FIGS. 5 and 6, an AC current Iac has a linear relation to a peak-to-peak voltage Vpp in an area less than twice a value of discharge start voltage Vth, i.e., Vth×2 (V) (undischarged area) and is then linearly increased gradually in a discharged area with an increasing peak-to-peak voltage value. In a similar experiment in a vacuum, the linearity of Iac is kept also in the discharged area, so that the resultant increment of Iac is regarded as a discharge current increment ΔIac which relates to the electric discharge.

When a ratio of the AC current Iac to the peak-to-peak voltage Vpp in the undischarged area less than Vth×2 (V) is taken as a, an AC current, other than the current due to discharge, such as a current flowing through a contact portion (hereinafter referred to a "nip current") is represented by a·Vpp. A difference ΔIac between the current value Iac measured during the application of a voltage equal to or more than Vth×2 (V) and the above value a·Vpp calculated according to the following formula 1 is defined as discharge current amount as a substitution for a discharge amount.

$$\Delta Iac = Iac - a \cdot \mathrm{Vpp} \quad \text{(formula 1)}$$

The discharge current amount ΔIac is changed depending on a change in environment and the number of sheets subjected to the image formation (durability) in the case of performing the charging under control with a constant voltage or with a constant current. This is because a relationship between the peak-to-peak voltage and the discharge current amount and a relationship between the AC current value and the discharge current amount are changed.

In an AC constant current control method, the charging of the member to be charged is controlled by a total amount of current flowing from the charging member (charging roller) to the member to be charged (photosensitive drum). The total current amount is, as described above, a sum of the nip current a·Vpp and the discharge current amount ΔIac which is carried by the discharge at the non-contact portion. In the constant current control method, the charge control is effected by current including not only the discharge current which is current necessary to actually charge electrically the member to be charged but also the nip current.

For this reason, the discharge current amount cannot be actually controlled. In the constant current control method, even in the case of effecting control at the same current value, depending on an environmental change of a material for the charging member, the discharge current amount is decreased when the nip current is increased and is increased when the nip current is decreased. For this reason, it is impossible to completely suppress a change (increase/decrease) in discharge current amount even by the AC constant current control method. When the life time of the image forming apparatus is intended to be prolonged, it was difficult to realize abrasion resistance of the photosensitive drum and the charging uniformity.

Therefore, in order to always obtain a desired discharge current amount, the control has been conventionally effected in the following manner.

When the desired discharge current amount (target current) in this embodiment is taken as D, a method of determining the peak-to-peak voltage providing the discharge current amount D will be described. In this embodiment, during a preparatory rotation operation for printing, the operation (computing)/determination program for the appropriate peak-to-peak voltage value of the AC voltage to be applied to the charging roller 12 in the charging step during the printing process is executed by the control circuit 103. Specifically, description will be made with reference to a Vpp-Iac graph in FIG. 7 and a control flow chart in FIG. 8.

Figure 7:
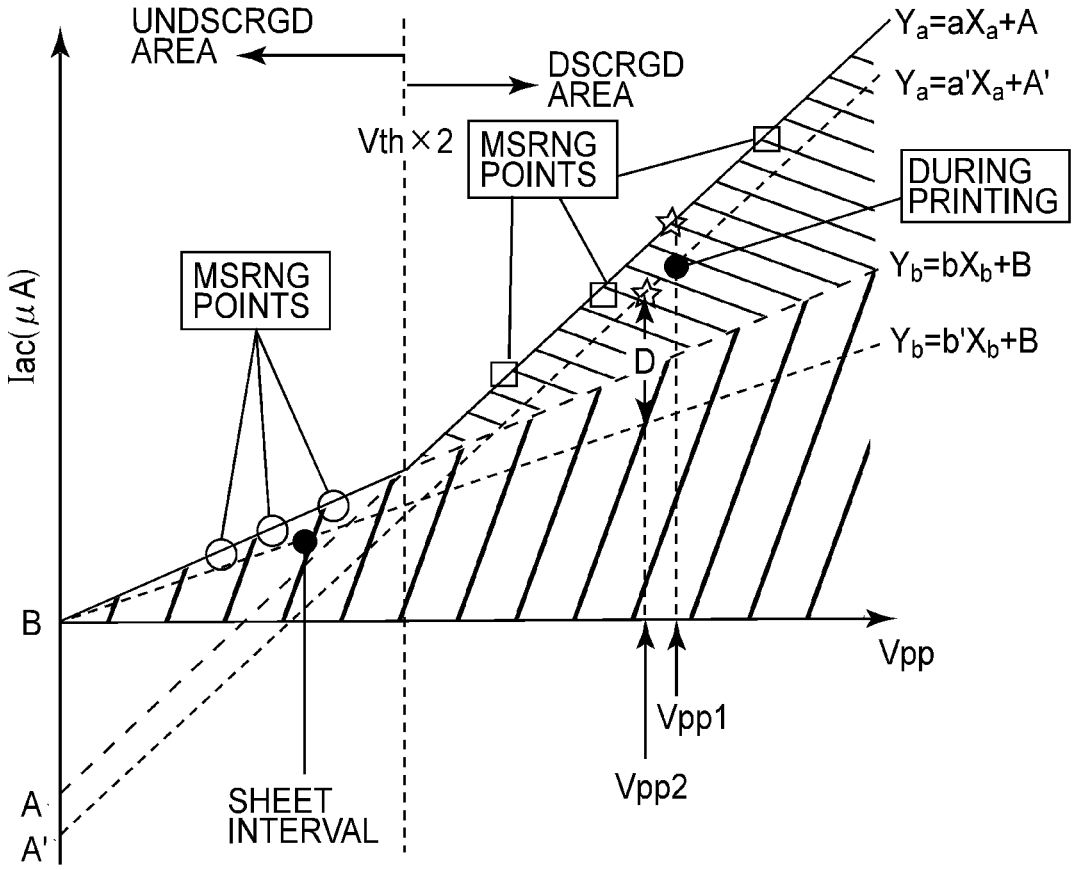
FIG. 7 is a graph, showing a relationship between the peak-to-peak voltage and the AC current, for illustrating control for setting an AC voltage.
Figure 8:
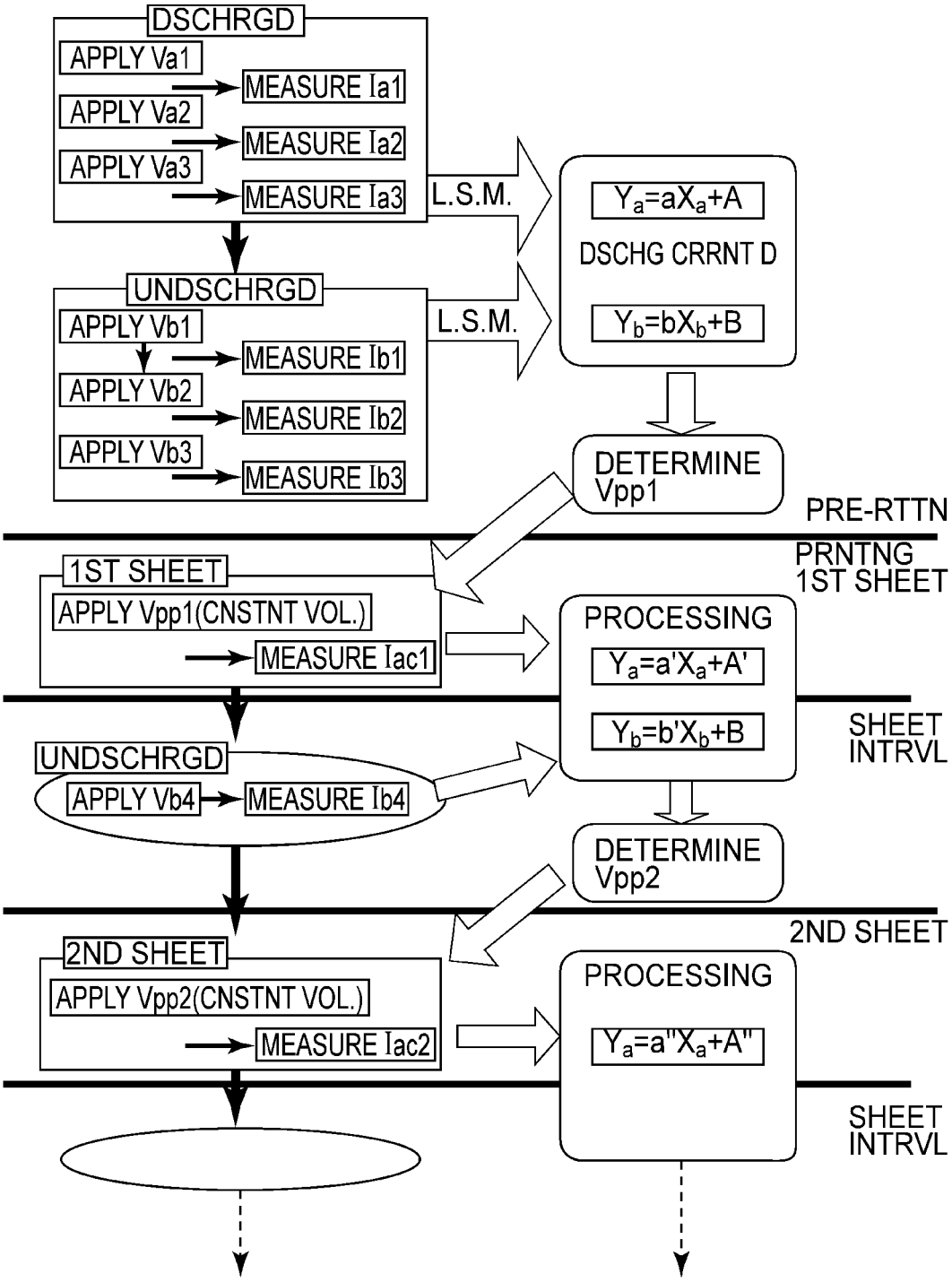
FIG. 8 is a schematic view for illustrating flow of the control for setting the AC voltage.

The control circuit 103 controls the AC power source 102 during the preparatory rotation operation for printing so that three peak-to-peak voltages (Vpp) in the discharged area and three peak-to-peak voltages in the undischarged area are successively applied, as sampling values, to the charging roller 12 as shown in FIG. 7. The resultant values of AC current flowing into the charging roller 12 via the photosensitive drum 11 are measured by the AC current value measuring circuit 104 and inputted into the control circuit 103. Next, the control circuit 103 performs collinear approximation of a relationship between the peak-to-peak voltage and the AC current in the discharged area and the undischarged area, respectively, on the basis of the three measured values in the discharged area and the three measured values in the undischarged area by using least square method to obtain the following formulas 2 and 3.

$$Ya = aXa + A \text{ (approximated line in discharged area)} \quad \text{(formula 2)}$$

$$Yb = bXb + B \text{ (approximated line in undischarged area)} \quad \text{(formula 3)}$$

Thereafter, the peak-to-peak voltage Vpp corresponding to the discharge current amount D is determined by formula 4 below as a difference between the above two formulas 2 and 3.

$$\mathrm{Vpp1} = (D - A + B)/(a - b) \quad \text{(formula 4)}$$

Here, a function fl1 (Vpp) showing a relationship between peak-to-peak voltage (Vpp) and AC current (Iac) in the undischarged area and a function fl2 (Vpp) showing a relationship between peak-to-peak voltage (Vpp) and AC current (Iac) in the discharged area correspond to formula 3 (Yb=bXb+B) and formula 2 (Ya=aXa+A), respectively. The constant D corresponds to the above-described desired discharge current amount D.

Accordingly, the discharge current amount D is represented by the formula below.

$$fl2(\mathrm{Vpp}) - fl1(\mathrm{Vpp}) = D$$

Therefore, the discharge current amount D is represented by the formula below.

$$Ya - Yb = (aXa + A) - (bXb + B) = D$$

Further, the formula 4, i.e., Vpp=(D−A+B)/(a−b) can be derived from the formula for D, i.e., fl2 (Vpp)−fl1 (Vpp)=D in the following manner.

The discharge current amount D is represented by the following formulas.

$$fl2(\mathrm{Vpp}) - fl1(\mathrm{Vpp}) = Ya - Yb = D$$

$$(aXa + A) - (bXb + B) = D$$

Now, assuming that a value of X providing D is sought and a resultant point is Vpp, the discharge current amount D is represented by the following formula.

$$(a\mathrm{Vpp} + A) - (b\mathrm{Vpp} + B) = D$$

Accordingly, the peak-to-peak voltage Vpp is represented by the following formula.

$$\mathrm{Vpp} = (D - A + B)/(a - b)$$

Then, the peak-to-peak voltage applied to the charging roller 12 is switched to Vpp1 obtained according to the formula 4 described above, and the operation goes to the above described process while effecting the constant voltage control with Vpp1.

During the printing process, the peak-to-peak voltage Vpp1 obtained as described above is applied to the charging roller 12, and a value of the AC current passing through the charging roller 12 at that time is measured by the AC current value measuring circuit 104 and inputted into the control circuit 103. In this case, Vpp1 is controlled with the constant voltage. In a non-image forming area between an image forming area and a subsequent image forming area (sheet interval), e.g., one the peak-to-peak voltage (Vpp) in the undischarged area is applied to the charging roller 12, and a value of the AC current passing through the charging roller 12 at that time is measured by the AC current value measuring circuit 104 and inputted into the control circuit 103. The control circuit 103 performs statistical processing based on a newly measured relationship between the peak-to-peak voltage and the AC voltage value and the relationship between the peak-to-peak voltage and the AC voltage value measured during the preparatory rotation operation for printing to obtain two formulas (5) and (6) below. That is, the control circuit 103 adds measuring points during the printing and during the sheet interval to the measuring points obtained in the control during the preparatory rotation operation for printing thus increasing the number of the measuring points, followed by recalculation using the least square method.

$$Ya=a'Xa+A \text{ (approximated line in discharged area)} \quad \text{(formula 5)}$$

$$Yb=b'Xb+B \text{ (approximated line in undischarged area)} \quad \text{(formula 6)}$$

Thereafter, a peak-to-peak voltage Vpp2 is determined, similarly as in the case of Vpp1 as the peak-to-peak voltage of the AC voltage applied to the charging roller 12 during the printing process, by using formula 7 below as the discharge current amount D which is a difference between the approximated line in the discharged area (formula 5) and the approximated line in the undischarged area (formula 6).

$$Vpp2=(D-A'+B)/(a'-b') \quad \text{(formula 7)}$$

Here, a function fI1' (Vpp) showing a relationship between corrected peak-to-peak voltage (Vpp) and AC current (Iac) in the undischarged area and a function fI2' (Vpp) showing a relationship between peak-to-peak voltage (Vpp) and AC current (Iac) in the discharged area correspond to formula 6 (Yb=b'Xb+B) and formula 5 (Ya=a'Xa+A), respectively.

The deviation of the formula 7 from the functions fI1' (vpp) and fI2' (Vpp) is performed in the same manner as that of the formula 4 from the functions of fI1 (Vpp) and fI2 (Vpp).

Then, the peak-to-peak voltage to be applied to the charging roller 12 is switched to Vpp2 obtained by the formula 7, so that the constant voltage control with Vpp is effected and thus the image formation is effected. Also in a subsequent printing process, the relationship between the peak-to-peak voltage and the AC current value is similarly measured during the printing process and the sheet internal, so that the peak-to-peak voltage of the AC voltage to be applied to the charging roller 12 during the printing process is always corrected during the printing operation.

Thus, the peak-to-peak voltage necessary to obtain a predetermined discharge current amount D during the printing process every time of the preparatory-rotation operation for printing is calculated, and during the printing process, the AC voltage of the obtained peak-to-peak voltage is applied to the charging roller while effecting the constant voltage control. Further, in a continuous printing mode, the AC current value during the printing process and the AC current value at the time of applying the AC voltage of the peak-to-peak voltage in the undischarged area to the charging roller 12 during the sheet interval (step) are measured, so that the peak-to-peak voltage of the AC voltage to be applied to a subsequent printing process. As a result, a manufacturing variation of the charging roller 12, deviation of a resistance value of the material due to environmental fluctuation, and a high-voltage variation of the apparatus main assembly are absorbed. Further, with respect to not only these factors but also a resistance value fluctuation of the charging roller 12 by the continuous printing, correction is made every sheet, so that it becomes possible to reliably effect the control with the desired discharge current amount. The above-described control method is hereinafter referred to as a discharge current amount control.

In this embodiment, when the AC current at the time of applying the peak-to-peak voltage (Vpp) in the undischarged area during the discharge current control is measured, the approximated line in the undischarged area is obtained by using the three peak-to-peak voltages (hereinafter referred to as sampling values) in the undischarged area. These sampling values are Vpp1, Vpp2 and Vpp3. Further, the approximated line in the discharged area is obtained by using the three peak-to-peak voltages (sampling values) in the discharged area. These sampling values are Vpp1', Vpp2' and Vpp3'.

Next, with reference to FIGS. 3 and 5, an example of a flow of control of setting of a charging condition in this embodiment will be described. Incidentally, the charging condition set correspondingly to the detection result of the environment sensor 50 is referred to as condition A', and a charging condition changed from the condition A' based on the above-described σ is referred to as condition B'.

When a main power source of the main assembly is turned on, charging control is started, (Y1). The main assembly CPU 201 as a corrector obtains temperature and humidity information inside the image forming apparatus from the environment sensor 50 in order to know the environment in which the main assembly is placed, and stores the information in a memory 202 in the main assembly. Then, the CPU 201 provides instructions, to a charging high-voltage control means 205, that a constant voltage αVpp is applied as a charging AC voltage to the charging roller 12.

The main assembly CPU 201 detects, from the AC current value measuring circuit 104, information on the charging AC current γ (μA) passing through the photosensitive drum 1 when the charging AC voltage αVpp is applied (Y2), and stores the information in the main assembly memory 202. Then, the main assembly CPU 201 derives the proper current value β, under application of the constant AC voltage αVpp, stored as the information in the memory 202 in advance, as information, depending on present temperature and humidity setting in the image forming apparatus obtained from the environment sensor 50 (Y3). Then, a differential current σ (μA) is calculated on the basis of formula Y' from the proper AC current value stored in advance as described above and an actually obtained value γ (μA) of the charging AC current passing through the photosensitive drum 11 when the charging AC voltage αVpp is applied.

$$\sigma=(\text{proper AC current value } \beta)-(\text{actually measured AC current value } \gamma) \quad \text{(formula Y')}$$

The CPU 201 discriminates whether or not the absolute value |σ| of the calculated differential current value is larger than an environment limit value |σ'| stored as information in the memory 202 in advance depending on the present temperature and humidity setting in the image forming apparatus (Y4). Then, the CPU 201 sets, in the case where the above-described differential current value |σ| is larger than the environment limit value |σ'|, the charging condition to the charging control condition B' different from the charging control condition A' set in advance depending on the present temperature and humidity setting in the image forming apparatus. This condition B is determined in a consideration of the positive and negative of σ. Examples of the control condition to be changed in the charging control condition B' may include the charging frequency, the target value (target current) of the discharge amount during the above-described discharge current control, and the sampling values in each of the discharged and undischarged areas during the above-described discharge current control (Y5). Therefore, in the case where the above-described differential current |σ| is larger than the environment limit value |σ'|, the above-described discharge current control is carried out under the control condition, as the condition, changed in the charging control condition B'. Then, in accordance with the charging setting determined in the discharge current control, the charging setting during the image formation or the initializing operation is determined (Y6).

On the other hand, in the case where the above-described differential current value |σ| is not more than the environment limit value |σ'|, the CPU 201 determines the charging setting in accordance with the ordinary charging control condition A' set in advance depending on the present temperature and humidity setting (Y7). As the charging control condition, similarly as described above, the charging frequency, the target value (target current) of the discharge amount during the above-described discharge current control, and the sampling values in each of the discharged and undischarged areas during the above-described discharge current control, and the like are changed in general. Therefore, in the case where the above-described differential current |σ| is larger than the environment limit value |σ'|, the above-described discharge current control is carried out under the control condition, as the condition, changed in the charging control condition A'. Then, in accordance with the charging setting determined in the discharge current control, the charging setting during the image formation or the initializing operation is determined (Y8).

Thus, the CPU 201 discriminates whether or not the above-described differential current value |σ| is larger than the environment limit value |σ'| and then changes the charging setting correspondingly to each of the charging conditions A' and B'. Then depending on the determined charging setting, the CPU 201 executes the image formation, an initial disposing operation, or necessary control for determining another image forming condition.

The initial disposing operation refers to an initializing operation of the developer when the developing device is mounted, an initializing operation of the drum cartridge when the drum cartridge is mounted, or the like operation. The necessary control for determining another image forming condition refers to toner content control, primary transfer control, control for determining primary transfer setting or the like, or the like control.

Further, in order to know an environment in which the main assembly is placed, temperature and humidity information obtaining timing in the image forming apparatus from the environment sensor 50 by the CPU 201 is not limited to only timing when the main power source is turned on but the information may also be always obtained. Further, the information may also be obtained at the time of start of a copy job. Therefore, the above-described contact flow is always performed every copy job, so that the charging setting condition may be determined. By always obtaining the temperature and humidity information, even during a continuous copying operation, it is also possible to change the setting by determining the control condition in accordance with the control flow in a sheet interval or the like and thereby carrying out the discharge current control.

A specific example of a normal charging condition A', a magnitude correlation between |σ| and |σ'| and a particular charging condition B' changed depending on the positive and negative of σ, at each of combinations of the temperatures and the humidities is shown in Table 2.

TABLE 2

| DETECTED | | AWC | | | | | | |
|---|---|---|---|---|---|---|---|---|
| T (° C.) | H (%) | (g/kg DryAir) | α (Vpp) | β (μA) | γ (μA) | σ (μA) | \|σ'\| (μA) | DV (Vpp) |
| 15 | 50 | 5.28 | 1000 | 750 | 700 | 50 | 200 | 1500 |
| 15 | 50 | 5.28 | 1000 | 750 | 500 | 250 | 200 | 2050 |
| 20 | 35 | 5.07 | 1000 | 800 | 500 | 300 | 280 | 2100 |
| 25 | 50 | 9.88 | 1000 | 1000 | 650 | 350 | 300 | 1850 |
| 30 | 80 | 21.58 | 1000 | 1400 | 900 | 500 | 450 | 1800 |
| 30 | 80 | 21.58 | 1000 | 1400 | 1800 | −400 | 300 | 1120 |
| 20 | 35 | 5.07 | 1000 | 800 | 1100 | −300 | 200 | 1450 |

| DETECTED | | CONDITION A' | | | | | | | |
|---|---|---|---|---|---|---|---|---|---|
| T | H | TGT | VOL. (Vpp) | | | VOL. (Vpp) | | | F |
| (° C.) | (%) | (μA) | Vpp1 | Vpp2 | Vpp3 | Vpp1' | Vpp2' | Vpp3' | (Hz) |
| 15 | 50 | 70 | 600 | 700 | 800 | 1400 | 1500 | 1600 | 2000 |
| 15 | 50 | — | — | — | — | — | — | — | — |
| 20 | 35 | 50 | 700 | 800 | 900 | 1500 | 1600 | 1700 | 2000 |
| 25 | 50 | 45 | 500 | 600 | 700 | 1300 | 1400 | 1500 | 2000 |
| 30 | 80 | 35 | 400 | 500 | 600 | 1100 | 1200 | 1300 | 2000 |
| 30 | 80 | 35 | 400 | 500 | 600 | 1100 | 1200 | 1300 | 2000 |
| 20 | 35 | 50 | 700 | 800 | 900 | 1500 | 1600 | 1700 | 2000 |

| DETECTED | | CONDITION B' | | | | | | | |
|---|---|---|---|---|---|---|---|---|---|
| T | H | TGT | VOL. (Vpp) | | | VOL. (Vpp) | | | F |
| (° C.) | (%) | (μA) | Vpp1 | Vpp2 | Vpp3 | Vpp1' | Vpp2' | Vpp3' | (kHz) |
| 15 | 50 | — | — | — | — | — | — | — | — |
| 15 | 50 | 100 | 1000 | 1100 | 1200 | 1700 | 1900 | 2100 | 1750 |
| 20 | 35 | 110 | 1100 | 1200 | 1300 | 1800 | 2000 | 2200 | 1750 |
| 25 | 50 | 80 | 950 | 1050 | 1150 | 1650 | 1850 | 2050 | 1750 |
| 30 | 80 | 60 | 900 | 1000 | 1100 | 1600 | 1800 | 2000 | 1750 |
| 30 | 80 | 25 | 300 | 400 | 500 | 1000 | 1100 | 1200 | 2000 |
| 20 | 35 | 30 | 500 | 600 | 700 | 1300 | 1400 | 1500 | 2000 |

Other constitutions and functions are similar to those in First Embodiment described above.

<Third Embodiment>

Figure 9:
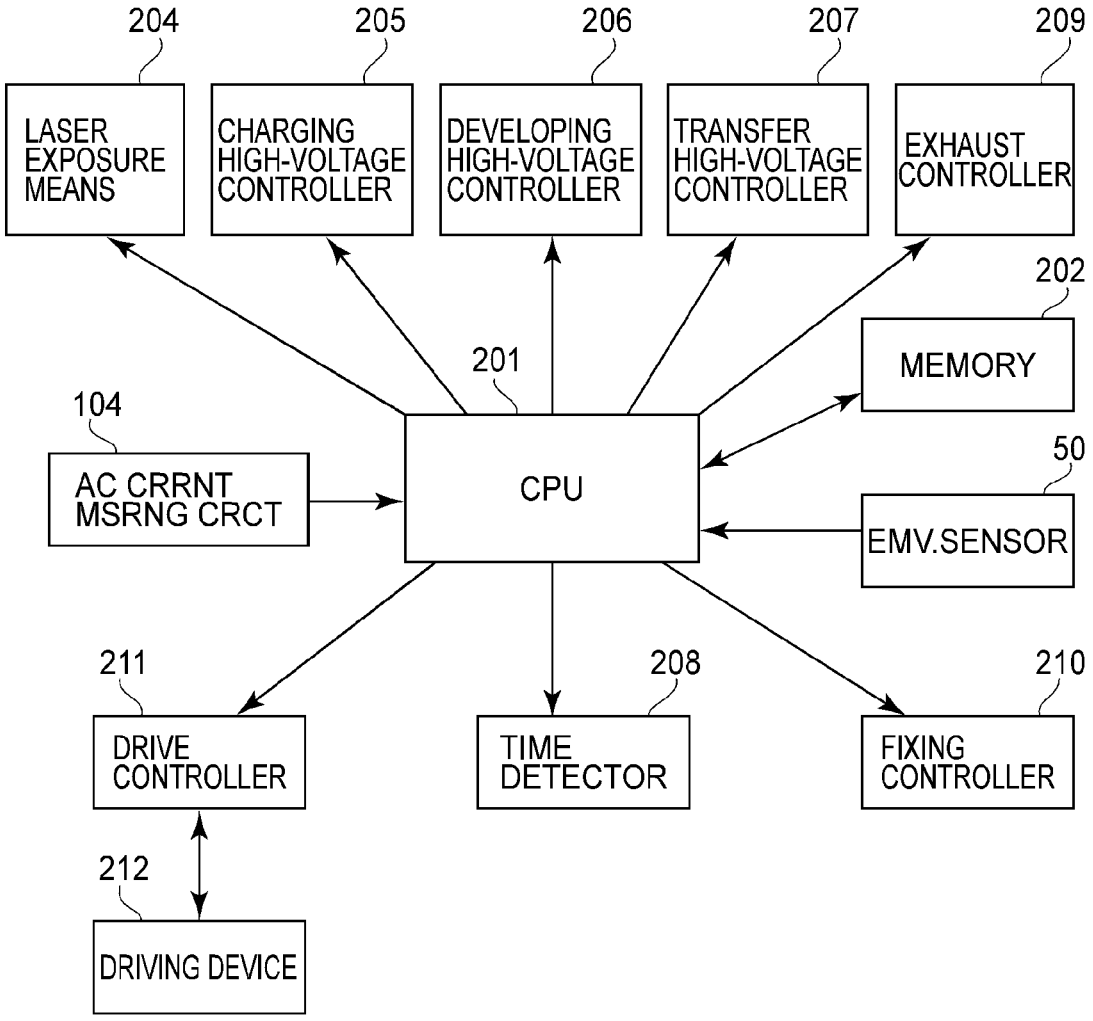
FIG. 9 is a control block diagram of an image forming apparatus according to Third Embodiment of the present invention.

Third Embodiment of the present invention will be described with reference to FIGS. 9 to 12 while making reference to FIGS. 1 and 2. In this embodiment, as shown in FIG. 9, a time detector 208 connected with the CPU 201 is provided and detects an elapsed time from the execution of the calculation of the differential current σ described in First and Second Embodiments. By detecting the elapsed time from the calculation of the differential current σ to carry out the discharge current control for charging, the fog and sandy place phenomena generated by the difference in temperature and humidity between the image forming apparatus and the charging roller 12 can be prevented with high accuracy. This will be described specifically.

In the case where the drum cartridge is carried from a different environment into the operation environment due to the exchange replacement) thereof, there arises the difference between the temperature and humidity of the image forming apparatus main assembly and the temperature and humidity of the charging roller 12. In that case, the temperature and humidity of the charging roller 12 gradually approach those in a temperature and humidity environment of the image forming apparatus main assembly after being disposed in the image forming apparatus main assembly. Thus, the temperature and humidity of the charging roller 12 gradually approach those of the image forming apparatus main assembly and therefore also the differential current σ is changed with the lapse of time. Accordingly, in order to effect more precise control, also after the charging control is effected, there is a need to adjust the discharge current amount on a several-second basis correspondingly to the temperature and humidity change.

Therefore, it would be considered that until the differential current |σ| becomes smaller than the environment limit value σ', the discharge current amount control is effected before the image formation, thus always performing optimum setting. However, even until the differential current |σ| becomes smaller than the environment limit value σ', when the discharge current amount control is effected every time, the electric discharge is generated although it is slight, and therefore there is a possibility that deterioration of the charging roller 12 is promoted. Further, when such control is frequently carried out before the image formation, it takes a longer time, until the image is outputted, than a normal operation. Thus, when the discharge current value control is frequently carried out, the low-temperature fog can be prevented but the photosensitive drum 11 and the charging roller 12 are deteriorated or it takes much time until the image is outputted.

For this reason, in this embodiment, the temperature and humidity change of the charging roller 12 is predicted from an elapsed time from the last discharge current amount control, so that the low-temperature fog, the sandy place phenomenon, and the like are prevented without frequently effecting the discharge current amount control.

That is, in this embodiment, as shown in FIG. 9, the time detector 208 for detecting the elapsed time from the detection of the current value γ by the AC current value measuring circuit 104 under application of a predetermined voltage a to the charging roller 12. The CPU 201 controls the determined current value γ to γ' on the basis of the time detected by the time detect or 208. Further, σ=(proper current value β)−(detected current value γ') is satisfied, and a limit value, of the absolute value |σ| of σ, corresponding to the temperature and humidity detected by the environment sensor 50 is |σ'|. Then, in the case where |σ| is larger than |σ'|, on the basis of the positive and negative of σ, the above-described charging condition corresponding to the temperature and humidity detected by the environment sensor 50 is changed.

The control in this embodiment will be specifically described. First, with reference to FIGS. 10 and 11, changes in charging AC voltage and charging (AC) frequency with the lapse of time in the cases where σ is positive and where the σ is negative, respectively, will be described. Parts (a) and (b) of FIG. 10 are graphs in the case where σ is positive, in which (a) of FIG. 10 shows a relationship the elapsed time and the AC voltage, and (b) of FIG. 10 shows the elapsed time and the frequency. That is, these figures show the case where the temperature of the charging roller 12 is lower than the detection temperature of the environment sensor 50 of the image forming apparatus main assembly.

In this case, the CPU 201 discriminates that there is a possibility of (dew) condensation until time t1, and does not apply the charging AC voltage and the charging frequency. During the period, by a condensation-preventing operation such as turning-off of the exhaust fan 37, the temperature of the charging roller 12 is made easy to increase, so that the temperature of the charging roller 12 is made close to the temperature of the apparatus main assembly. From time t2 when the temperature difference is eliminated and thus the possibility of the condensation is eliminated to some extent, application of the charging high voltage is carried out. Here, in the case where σ is positive, the temperature of the charging roller 12 is low and the current does not readily flow, and therefore the AC voltage is set at a high level of first and then the set value is gradually lowered with the lapse of the time. Further, when the frequency is high in a state in which the resistance is high, there is a possibility that the fog is generated, and therefore the frequency is set at a low level of first and then the set value is gradually increased with the lapse of the time. Parts (*a*) and (*b*) of FIG. 11 are graphs in the case where σ is negative, in which (*a*) of FIG. 11 shows a relationship the elapsed time and the AC voltage, and (*b*) of FIG. 11 shows the elapsed time and the frequency. That is, these figures show the case where the temperature of the charging roller 12 is higher than the detection temperature of the environment sensor 50 of the image forming apparatus main assembly.

In this case, the temperature of the charging roller 12 is high and therefore there is a low possibility of the condensation of the charging roller 12. For this reason, unless abnormality of the image forming apparatus main assembly is discriminated, the charging high voltage can be applied. Here, in the case where σ is negative, the temperature of the charging roller 12 is high and the current does not readily flows, and therefore the AC voltage is set at a low level of first and then the set value is gradually increased with the lapse of the time. Further, when the charging roller 12 is not in a state in which its resistance is high, and therefore the frequency is changed with the lapse of the time as shown in the figure (or is kept at a constant level).

In the case where the temperature of the charging roller 12 is low and thus the charging roller 12 has already been in the condensation state, there is a possibility that σ is detected as being negative. That is, when the charging roller 12 causes the condensation, water is deposited on the surface of the charging roller 12 and therefore the charging roller 12 is in a state in which the current flows easily. For this reason, σ becomes a very large value of negative. In this case, the condensation-preventing (recovering) operation described later is performed, and when the charging roller 12 recovers from the condensation state, the charging high voltage is applied similarly as in the case of FIG. 10. In the case where the charging roller 12 has already caused the condensation, in order to recover the charging roller 12 from the condensation state, a recovering operation time from the condensation is made longer or the temperature of the fixing unit 40 is set at a higher level. Thus, the control content is, compared with the case of FIG. 10, made so that the charging roller 12 can readily recover from the condensation.

Next, a control flow in this embodiment will be described with reference to FIGS. 9 and 12. First, the timing reaches start timing of the charging control (Z1).

The main assembly CPU 201 obtains temperature and humidity information inside the image forming apparatus from the environment sensor 50 in order to know the environment in which the main assembly is placed, and stores the information in a memory 202 in the main assembly. The CPU 201 derives the proper current value β, under application of the constant AC voltage αVpp, stored as the information in the memory 202 in advance, as information, from the temperature and humidity information obtained by the environment sensor 50 (Z2). Then, the CPU 201 checks whether or not the differential current σ, obtained by calculating the difference between the proper AC current value β and the AC current value γ detected under application of αVpp to the charging roller 12, has been previously calculated (Z3).

In (Z3), when there is no record that the differential current σ has been previously calculated, the CPU 201 provides instructions, to a charging high-voltage control means 205, that a constant voltage αVpp is applied as a charging AC voltage to the charging roller 12.

The main assembly CPU 201 detects, from the AC current value measuring circuit 104, information on the charging AC current γ (μA) passing through the photosensitive drum 1 when the charging AC voltage αVpp is applied, and stores the information in the main assembly memory 202. Then, the difference between the charging AC current γ and the proper AC current β calculated in (Z2) is calculated to obtain the differential current σ (Z7).

On the other hand, in (Z3), when the differential current σ has been previously calculated, by the time detector 208 connected with the CPU 201, an elapsed time t from the time when the differential current σ is previously calculated is detected. From the elapsed time t, how the temperature and humidity of the charging roller 12 changes can be predicted, so that an amount corresponding to the temperature and humidity change from that at the time when the differential current σ is previously calculated is estimated (Z4). For example, by previous study, temperature-converged values in each operation of the image forming apparatus are compiled into a data base. Then, when an initial value before the operation is known, it is possible to estimate the temperature by a method in which a temperature change amount with time is added (or subtracted).

In this case, not only the elapsed time but also a main assembly operation status including turning-off/on of the image forming apparatus main assembly, rotation times of the photosensitive drum 11 and the intermediary transfer belt 31, outputs of the heaters, a speed of the exhaust fan 37 as an exhausting device, a temperature of the fixing unit 40 as a fixing device, and the like is also recorded (stored) in the memory 202. Further, by taking the main assembly operation status into consideration, the temperature and humidity of the charging roller 12 may preferably be estimated and calculated. That is, as the above-described data base, a database obtained by taking such a main assembly operation status into consideration is used.

Then, on the basis of the estimated temperature and humidity calculated from the elapsed time t in (Z4), from the information recorded in the memory 202 in advance, the AC current value γ under application of αVpp to the charging member is corrected to γ' (Z5). Similarly as in the case of the differential current a calculated in First and Second Embodiments, by using formula Z below, a difference between the corrected AC current value γ' and the proper AC current value β is calculated to obtain the differential current σ (Z6).

σ=(proper AC current value β)−(AC current value γ' in view of elapsed time *t*) (formula Y')

The CPU 201 discriminates whether or not the absolute value |σ| of the differential current value σ calculated in (Z6) or (Z7) is larger than an environment limit value |σ'| stored as information in the memory 202 in advance depending on the present temperature and humidity setting in the image forming apparatus (Z8). Then, the CPU 201 sets, in the case where |σ| is larger than the environment limit value |σ'|, the charging condition to the charging control condition B' different from the charging control condition A' set in advance depending on the present temperature and humidity setting in the image forming apparatus. This condition B is determined in a consideration of the positive and negative of σ. Examples of the control condition to be changed in the charging control condition B' may include the charging frequency, the target value (target current) of the discharge amount during the above-described discharge current control, and the sampling values in each of the discharged and undischarged areas during the above-described discharge current control (Z9). Incidentally, in the case where the control is effected as in First Embodiment, the CPU 201 changes the charging condition to the charging setting condition B different from the charging setting condition A set in advance depending on the present temperature and humidity setting in the image forming apparatus. This condition B is determined in a consideration of the positive and negative of σ. The charging condition to be changed is at least one of the AC voltage frequency and the AC voltage value. Therefore, in the case where the above-described differential current |σ| is larger than the environment limit value |σ'|, the above-described discharge current control is carried out under the control condition, as the condition, changed in the charging control condition B'. Then, in accordance with the charging setting determined in the discharge current control, an environment-dependent image forming condition during the image formation or the initializing operation is determined (Z10).

For example, in the case where the temperature and humidity of the charging roller 12 estimated in the process of (Z3) to (Z8) is lower than the temperature and humidity detected by the environment sensor 50 of the image forming apparatus, this means that the temperature of the charging roller 12 is lower than the temperature of the image forming apparatus main assembly. Further, the charging roller 12 is in a high humidity state, there is a possibility that the photosensitive drum 11 and the charging roller 12 are in (dew) condensation state. Therefore, in this case, the condensation-preventing (recovering) operation is performed (Z10).

As this condensation-preventing operation, an operation for decreasing the speed of the exhaust fan 37, for adjusting the temperature and air flow of the image forming apparatus, to zero or a low value may be employed. That is, an exhaust control circuit 209 for effecting the operation and control of air volume of the exhaust fan 37 as the exhaust device performs the operation and adjustment of air volume of the exhaust fan 37. In this case, when |σ| is very large and σ is the negative value, there is a possibility of generation of the condensation. Further, σ is the positive value, the condensation is liable to generate. For this reason, the exhaust control circuit 209 controls the exhaust fan 37 as described above to perform recovery from the condensation state or condensation prevention.

Further, it would be considered that the temperature of the fixing device 40 set at a higher level than a normal level. That is, a fixing control circuit 210 controls temperature setting of the fixing unit 40 on the basis of the magnitude correlation between |σ| and |σ'| and the positive and negative of σ. In the case where on the basis of σ calculated as described above, there is a high possibility of generation of the condensation or the charging roller 12 is in the state in which the condensation is liable to generate, the fixing control circuit 210 sets the temperature of the fixing unit 40 at a higher level than a normal level to perform the recovery from the condensation or the condensation prevention.

In either case, by the above-described operation, the control is effected so that the difference in temperature between the charging roller 12 and the image forming apparatus main assembly becomes small. As a result, heat is quickly conducted to the charging roller 12, so that the temperature of the charging roller 12 becomes easy to increase.

Further, the photosensitive drum 11 may also be idled. That is, a drive control circuit 211 for controlling drive of a driving device 212 such as a motor for rotationally driving the photosensitive drum 11 controls the drive of the driving device 212 on the basis of the magnitude correlation between $|\sigma|$ and $|\sigma'|$ and the positive and negative of $\sigma$. In the case where on the basis of $\sigma$ calculated as described above, there is a high possibility of generation of the condensation or the charging roller 12 is in the state in which the condensation is liable to generate, the drive control circuit 211 controls the driving device 212 to cause the photosensitive drum 11 to idle, thereby to perform the recovery from the condensation or the condensation prevention.

In this case, when the condensation state is formed, it is not preferable that the charging and the transfer are effected with the electric discharge, and therefore the charging and transfer settings are not made or made so that their levels are smaller than normal levels. Further, when the developing device 14 is in a state in which development can be made, a solid image can be formed to quickly remove a deposited matter on the photosensitive drum 11 and the charging roller 12 by friction of the toner with the cleaning device 15, so that an adverse affect by the condensation can be quickly eliminated.

On the other hand, the case where the temperature and humidity of the charging roller 12 estimated in the process of (Z3) to (Z8) is higher than the temperature and humidity detected by the environment sensor 50 of the image forming apparatus will be described. As such a case, the case where the drum cartridge which is left standing in the outside and becomes hot is mounted into the image forming apparatus main assembly which is mounted in the office in a cooling environment in the summer season would be assumed. In this case, there is a possibility that image flow and turning-up of the blade of the cleaning device 15 are generated by excessive current from the charging roller, and therefore it is desirable that the charging condition is changed to such a charging condition that the discharge current amount is lowered as described above with reference to FIG. 11. Further, in the case, the speed of the exhaust fan 37 for adjusting the temperature and the air flow of the image forming apparatus is increased for lowering the temperature of the charging roller 12, or the temperature of the fixing unit 40 is set at a low level. Thus, the control is made so that the temperature difference between the charging roller 12 and the image forming apparatus main assembly becomes small.

As described above, the control may only be required to be appropriately effected depending on the temperature difference between the image forming apparatus main assembly and the charging roller 12. After the execution of the step (Z10), it is preferable that the temperature of the charging roller 12 is estimated and then a small temperature difference is checked again to end the control.

In (Z8), in the case where the above-described differential current value $|\sigma|$ is not more than the environment limit value $|\sigma'|$, the CPU 201 determines the charging setting in accordance with the ordinary charging control condition A' set in advance depending on the present temperature and humidity setting (Z11). Then, in accordance with the charging setting determined in the discharge current control, the environment-dependent image forming condition during the image formation or the initializing operation is determined (Z12).

Incidentally, it is difficult to predict, for a long term, the execution of the charging control effected under a particular control condition in (Z9) and (Z11). However, the execution of the charging control can be predicted from the temperature change based on the previous result if the period is a period in which the temperature of the drum cartridge carried from a different environment is accustomed to the operation environment or a short period such as that during initial disposition, so that the execution of the charging control can be omitted by the prediction. By predicting the execution of the charging control in (Z9) and (Z11), the number of occurrences of the electric discharge can be reduced, so that, e.g., when the condensation state is formed, the adverse affect due to the electric discharge can be prevented.

Thus, the CPU 201 discriminates whether or not the differential current value $|\sigma|$ is larger than the environment limit value $|\sigma'|$ and then changes the charging setting correspondingly to each of the charging conditions A' and B'. Then depending on the determined charging setting, the CPU 201 executes the image formation, an initial disposing operation, or necessary control for determining another image forming condition.

The initial disposing operation refers to an initializing operation of the developer when the developing device is mounted, an initializing operation of the drum cartridge when the drum cartridge is mounted, or the like operation. Incidentally, during the initializing operation, when the photosensitive drum causes the condensation, there is a possibility that an error occurs when a density (concentration) sensor for detecting the toner content is initialized. That is, in such a case, the fog as described above is generated, so that the toner content in the developing device is changed. As a result, sensitivity of the sensor is deviated from a proper range, so that the error occurs. For this reason, in such a case, the error is prevented from occurring by enlarging an allowable range during the initialization of the sensor more than during normal use. That is, by obtaining the differential current value as described above and then by comparing the obtained differential current value with the environment limit value, whether or not the photosensitive drum is in the state in which the condensation is generated is discriminated. When the photosensitive drum is in the state in which the condensation is generated, the allowable range during the initialization of the sensor is enlarged more than in a normal state which is a state where the condensation is not generated.

For example, in the case where a 8 bit-sensor is used as a toner content detecting means, detection values in the range from 0 to 255 can processed, so that an initial value of a sensitivity center is adjusted and set at a value in the neighborhood of 128 which is the center of the detection range in many cases. At that time, the allowable range of the sensor set in a range of 128±13 in a normal state is enlarged to 128±26 along the flow of FIG. 12 in the case where the differential current value $|\sigma|$ is larger than $|\sigma'|$. As a result, the error does not readily occur when the sensor is initialized.

As described above, the necessary control for determining another image forming condition refers to fan control, fixing temperature adjustment, photosensitive drum rotation control, toner content control, primary transfer control, control for determining primary transfer setting or the like, or the like control. Other constitutions and functions are similar to those in Second Embodiment described above.

In the above-described embodiments, a system including a cleaning member for the photosensitive drum is described but the present invention is also applicable to a so-called cleaner-less system which does not include the cleaning member for the photosensitive drum. In the cleaner-less system, in the case where an auxiliary charging member for applying the high voltage is used in place of the cleaning member, a set value of the auxiliary charging member may be adjusted depending on a degree of the influence of the electric discharge on the photosensitive drum.

Further, in order to know an environment in which the main assembly is placed, temperature and humidity information obtaining timing in the image forming apparatus from the environment sensor 50 by the CPU 201 is not limited to only timing when the main power source is turned on but the information may also be always obtained. Similarly, also the temperature estimation of the charging roller 12 may also be always made by calculation in view of the operation status of the image forming apparatus main assembly. Naturally, different from the estimation, when the temperature and humidity detecting means is provided in the drum cartridge, the charging roller temperature can be controlled with high accuracy. By always obtaining the temperature and humidity information, even during the continuous copying operation, it is possible to prevent the generation of defective image by determining the control condition in the sheet interval or the like in accordance with the control flow and then by executing the discharge current control.

Further, the above-described embodiments can be carried out in appropriate combination. For example, the condensation-preventing (recovering) operation described in Third Embodiment may be performed also in First and Second Embodiment.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 002190/2012 filed Jan. 10, 2012, which is hereby incorporated by reference.

What is claimed is:

1. An image forming apparatus comprising:

a photosensitive member;

a rotatable charging member for electrically charging said photosensitive member by electric discharge;

a bias applying device for applying a charging bias, to said rotatable charging member, in the form of a DC voltage biased with an AC voltage;

a current detector for detecting an AC current passing between said rotatable charging member and said photosensitive member when an AC voltage is applied to said rotatable charging member by said bias applying device;

a temperature and humidity detector for detecting a temperature and a humidity in said image forming apparatus; and a setting device for setting a peak-to-peak voltage of the AC voltage in the charging bias on the basis of a plurality of AC currents, detected by said current detector, passing between said rotatable charging member and said photosensitive member when a plurality of AC voltages including a peak-to-peak voltage which is less than twice a discharge start voltage and a peak-to-peak voltage which is equal to or more than twice the discharge start voltage, depending on an output of said temperature and humidity detector, are applied to said rotatable charging member, wherein when an AC current detected by said current detector under application of a predetermined AC voltage to said rotatable charging member is within a predetermined range corresponding to an output of said temperature and humidity detector, said setting device sets the peak-to-peak voltage of the AC voltage in the charging bias on the basis of the plurality of AC currents, and when an AC current detected by said current detector under application of the predetermined AC voltage to said rotatable charging member is out of the predetermined range, said setting device sets the peak-to-peak voltage of the AC voltage in the charging bias on the basis of the AC current which is out of the predetermined range.

2. An image forming apparatus according to claim 1, wherein when the AC current detected by said current detector under application of the predetermined AC voltage to said rotatable charging member is out of the predetermined range and is a first AC current, said setting device sets a first peak-to-peak voltage of the AC voltage as the peak-to-peak voltage of the AC voltage in the charging bias, and wherein when the AC current detected by said current detector under application of the predetermined AC voltage to said rotatable charging member is out of the predetermined range and is a second AC current which is smaller than the first AC current, said setting device sets a second peak-to-peak voltage which is larger than the first peak-to-peak voltage of the AC voltage as the peak-to-peak voltage of the AC voltage in the charging bias.

3. An image forming apparatus comprising:

a photosensitive member;

a rotatable charging member for electrically charging said photosensitive member by electric discharge;

a bias applying device for applying a charging bias, to said rotatable charging member, in the form of a DC voltage biased with an AC voltage;

a current detector for detecting an AC current passing between said rotatable charging member and said photosensitive member when an AC voltage is applied to said rotatable charging member by said bias applying device;

a temperature and humidity detector for detecting a temperature and a humidity in said image forming apparatus; and a setting device for setting a peak-to-peak voltage of the AC voltage in the charging bias on the basis of a plurality of AC currents, detected by said current detector, passing between said rotatable charging member and said photosensitive member when a plurality of AC voltages including a peak-to-peak voltage which is less than twice a discharge start voltage and a peak-to-peak voltage which is equal to or more than twice the discharge start voltage, depending on an output of said temperature and humidity detector, are applied to said rotatable charging member, wherein when an AC current detected by said current detector under application of a predetermined AC voltage to said rotatable charging member is within a predetermined range corresponding to an output of said temperature and humidity detector, said setting device sets the peak-to-peak voltage of the AC voltage in the charging bias on the basis of the plurality of AC currents, and when an AC current detected by said current detector under application of the predetermined AC voltage to said rotatable charging member is out of the predetermined range, said setting device sets the peak-to-peak voltage of the AC voltage in the charging bias on the basis of the plurality of AC currents, detected by said current detector, passing between said rotatable charging member and said photosensitive member when a plurality of AC voltages, each on the basis of the AC current which is out of the predetermined range, are applied to said rotatable charging member.

4. An image forming apparatus comprising:

a photosensitive member;

a rotatable charging member for electrically charging said photosensitive member by electric discharge;

a bias applying device for applying a charging bias, to said rotatable charging member, in the form of a DC voltage biased with an AC voltage;

a current detector for detecting an AC current passing between said rotatable charging member and said photosensitive member when an AC voltage is applied to said rotatable charging member by said bias applying device;

a temperature and humidity detector for detecting a temperature and a humidity in said image forming apparatus; and a setting device for setting a peak-to-peak voltage of the AC voltage in the charging bias on the basis of an output of said temperature and humidity detector, wherein when an AC current detected by said current detector under application of a predetermined AC voltage to said rotatable charging member is within a predetermined range corresponding to an output of said temperature and humidity detector, said setting device sets the peak-to-peak voltage of the AC voltage in the charging bias on the basis of the output of said temperature and humidity detector, and when an AC current detected by said current detector under application of the predetermined AC voltage to said rotatable charging member is out of the predetermined range, said setting device sets the peak-to-peak voltage of the AC voltage in the charging bias on the basis of the AC current which is out of the predetermined range.

5. An image forming apparatus according to claim 4, wherein when the AC current detected by said current detector under application of the predetermined AC voltage to said rotatable charging member is out of the predetermined range and is a first AC current, said setting device sets a first peak-to-peak voltage of the AC voltage as the peak-to-peak voltage of the AC voltage in the charging bias, and wherein when the AC current detected by said current detector under application of the predetermined AC voltage to said rotatable charging member is out of the predetermined range and is a second AC current which is smaller than the first AC current, said setting device sets a second peak-to-peak voltage which is larger than the first peak-to-peak voltage of the AC voltage as the peak-to-peak voltage of the AC voltage in the charging bias.

6. An image forming apparatus comprising:

a photosensitive member;

a rotatable charging member for electrically charging said photosensitive member by electric discharge;

a bias applying device for applying a charging bias, to said rotatable charging member, in the form of a DC voltage biased with an AC voltage;

a current detector for detecting an AC current passing between said rotatable charging member and said photosensitive member when an AC voltage is applied to said rotatable charging member by said bias applying device;

a temperature and humidity detector for detecting a temperature and a humidity in said image forming apparatus; and a setting device for executing an operation in a mode in which a plurality of AC voltages on the basis of an output of said temperature and humidity detector are applied to said rotatable charging member, and a peak-to-peak voltage of the AC voltage in the charging bias is set on the basis of a plurality AC currents detected by said current detector under application of the plurality of AC voltages, wherein the plurality of AC voltages includes a peak-to-peak voltage which is less than twice a discharge start voltage and a peak-to-peak voltage which is equal to or more than twice the discharge start voltage, and wherein when the AC current detected by said current detector under application of a predetermined AC voltage to said rotatable charging member is within a predetermined current range, said setting device executes the operation in the mode, and when the AC current detected by said current detector under application of the predetermined AC voltage to said rotatable charging member is out of the predetermined range, said setting device sets the peak-to-peak voltage of the AC voltage in the charging bias on the basis of the AC current without executing the operation in the mode and without being based on an output of said temperature and humidity detector.

* * * * *